US011532472B2

(12) United States Patent
Suzuki et al.

(10) Patent No.: US 11,532,472 B2
(45) Date of Patent: Dec. 20, 2022

(54) MASS SPECTROMETRY

(71) Applicant: Ricoh Company, Ltd., Tokyo (JP)

(72) Inventors: Kazumi Suzuki, Shizuoka (JP); Katsuyuki Uematsu, Shizuoka (JP); Hiroyuki Suhara, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 6 days.

(21) Appl. No.: 17/372,034

(22) Filed: Jul. 9, 2021

(65) Prior Publication Data

US 2022/0037141 A1 Feb. 3, 2022

(30) Foreign Application Priority Data

Jul. 30, 2020 (JP) ..... JP2020-129034
Jun. 9, 2021 (JP) ..... JP2021-096362

(51) Int. Cl.
*H01J 49/16* (2006.01)

(52) U.S. Cl.
CPC ..... *H01J 49/164* (2013.01)

(58) Field of Classification Search
CPC ..... H01J 49/164
See application file for complete search history.

(56) References Cited

U.S. PATENT DOCUMENTS

2020/0303176 A1 9/2020 Uematsu et al.

FOREIGN PATENT DOCUMENTS

| | | |
|---|---|---|
| EP | 3 263 339 A1 | 1/2018 |
| EP | 3 712 922 A1 | 9/2020 |
| EP | 3 886 141 A1 | 9/2021 |
| JP | 2001-153842 | 6/2001 |
| JP | 2002-148157 | 5/2002 |
| JP | 2012-143787 | 8/2012 |
| JP | 2014-206389 | 10/2014 |
| JP | 2020-160046 | 10/2020 |

OTHER PUBLICATIONS

Guo Shuai et al: "Enhancement of On-tissue Chemical Derivatization by Laser-Assisted Tissue Transfer for MALDI MS Imaging", Analytical Chemistry, vol. 92, No. 1, Dec. 4, 2019 (Dec. 4, 2019), pp. 1431-1438, XP055922230.
Extended European Search Report dated May 30, 2022, in corresponding European Patent Application 21185298.3.
Partial European Search Report dated Jan. 3, 2022 in European Patent Application No. 21185298.3, 13 pages.
Annett Urbanek, et al., "Multigrid MALDI mass spectrometry imaging (mMALDI MSI)", Analytical and Bioanalytical Chemistry, vol. 408, No. 14, Apr. 2, 2016, pp. 3769-3781, XP035867759.

*Primary Examiner* — Nicole M Ippolito
*Assistant Examiner* — Hanway Chang
(74) *Attorney, Agent, or Firm* — Xsensus LLP

(57) ABSTRACT

Provided is mass spectrometry including applying a laser beam to a matrix dot disposed on a surface of a measurement sample. One of: a laser spot appearing in the measurement sample when the laser beam is applied to the matrix dot; and the matrix dot, is completely enclosed in the other.

15 Claims, 19 Drawing Sheets

MASS SPECTROMETRY

CROSS-REFERENCE TO RELATED APPLICATIONS

This patent application is based on and claims priority pursuant to 35 U.S.C. § 119(a) to Japanese Patent Application Nos. 2020-129034 and 2021-096362, filed on Jul. 30, 2020 and Jun. 9, 2021, respectively, in the Japan Patent Office, the entire disclosure of each of which is hereby incorporated by reference herein.

BACKGROUND

Technical Field

The present disclosure relates to mass spectrometry.

Description of the Related Art

Mass spectrometry is an analytical method where a sample containing a target molecule is ionized to separate and detect ions derived from the target molecule with a mass-to-charge ratio (m/z), and information related to identification of a chemical structure of the target molecule is obtained.

Ionization of a sample of mass spectrometry is a factor determining the quality of analysis, and numerous methods of ionization have been developed. Examples include matrix assisted laser desorption/ionization (MALDI) and electrospray ionization (ESI). Since ionization is easily performed in these methods even with a very small amount of a sample, these methods have been used in technical fields of biotechnology and medicines.

In MALDI mass spectrometry, application of a matrix to a sample is followed by irradiation of pulsed laser, where the matrix is a material for assisting ionization of the sample, and the sample is ionized together with the matrix.

In MALDI mass spectrometry, various methods for applying a matrix to a sample have been proposed. In MALDI mass spectrometry, however, obtained results may greatly change depending on the skills of persons who prepare samples, and precise quantitative analysis is difficult.

SUMMARY

According to one aspect of the present disclosure, mass spectrometry includes a laser beam irradiation step of applying a laser beam to a matrix dot disposed on a surface of a measurement sample. One of: a laser spot appearing in the measurement sample when the laser beam is applied to the matrix dot; and the matrix dot, is completely enclosed in the other.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1A:
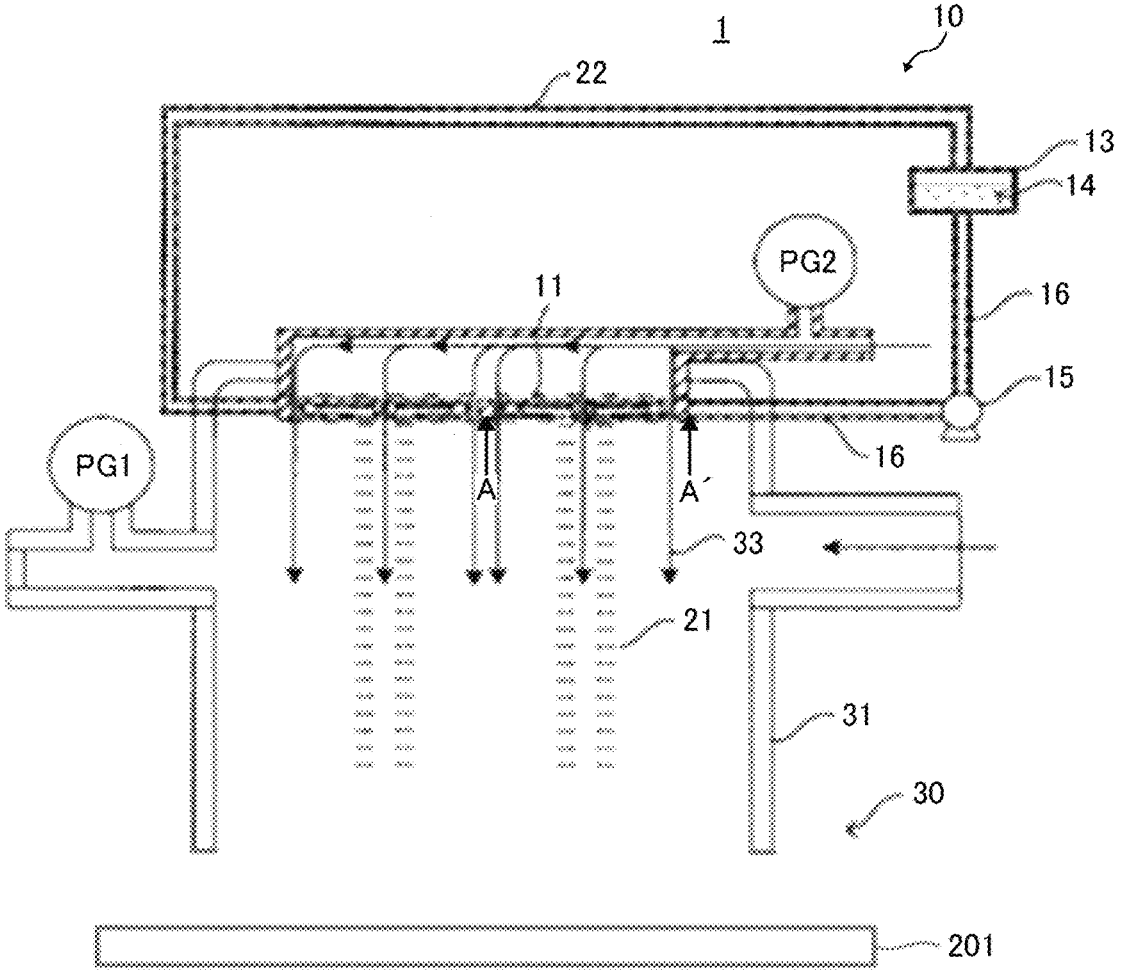
FIG. 1A is a schematic view illustrating one example of a powder forming device as a whole.

The accompanying drawings are intended to depict embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

According to the present disclosure, it is possible to provide mass spectrometry that can achieve precise quantitation.

(Mass Spectrometry)

The mass spectrometry of the present disclosure is mass spectrometry performed by applying a laser beam to a matrix dot disposed on a surface of a measurement sample. The mass spectrometry includes a laser beam irradiation step of applying the laser beam in a manner that one of: a laser spot appearing in the measurement sample when the laser beam is applied to the matrix dot; and the matrix dot, is enclosed in the other. More specifically, the following condition (A) or (B) is satisfied:

condition (A) in which the laser spot appearing in the measurement sample when the laser beam is applied to the matrix dot for mass spectrometry is completely enclosed in the matrix dot; or condition (B) in which the matrix dot is completely enclosed in the laser spot appearing in the measurement sample when the laser beam is applied to the matrix dot.

If necessary, the method further includes other steps.

The mass spectrometry of the present disclosure is one mass spectrometric technique of disposing a matrix for mass spectrometry to a surface of a measurement sample in the form of dots and applying a laser beam to a region where the matrix is disposed, to thereby ionize the measurement sample.

MALDI mass spectrometry is one example of the mass spectrometry of applying a laser beam to the measurement sample to ionize the measurement sample.

MALDI is an abbreviation of Matrix Assisted Laser Desorption/Ionization, which is one of the methods of mass spectrometry.

In mass spectrometry using the MALDI (hereinafter referred to as "MALDI mass spectrometry"), mass spectrometry is performed by applying pulsed laser to a position of a sample where a matrix, which is a material for assisting ionization, is deposited, to thereby ionize the sample together with the matrix.

The matrix for use is selected for components to be analyzed in the sample.

When the matrix for mass spectrometry is disposed on the surface of the measurement sample in the form of dots, there exist a region where the matrix is not disposed on the surface of the measurement sample. Depending on the position of the laser beam irradiated for ionization, a region to be irradiated with the laser beam in the region where the matrix is disposed may vary with the matrix dots. As a result, the amount of the measurement sample to be subjected to mass spectrometry varies for irradiation with the laser beam, and there may be difficulty in obtaining quantifiable mass analysis results. This is the finding obtained by the present inventors.

In view thereof, the present inventors have found that highly precisely quantifiable mass spectrometry can be provided by controlling the relationship between the matrix dots and the irradiated laser beam in a method of performing mass spectrometry by applying a laser beam to matrix dots for mass spectrometry that are disposed on the surface of a measurement sample.

First, description will be given to a method for preparing a measurement sample for mass spectrometry, where a matrix for mass spectrometry is disposed on the surface of the measurement sample in the form of dots.

[Method for Preparing Measurement Sample for Mass Spectrometry]

A method for preparing a measurement sample for mass spectrometry includes applying a laser beam to a base including a matrix used for preparing the measurement sample for mass spectrometry, where the matrix is disposed on a surface of the base, in a manner that the laser beam is applied to a surface of the base opposite to the surface on which the matrix is disposed, to make the matrix fly from the base to be disposed at a predetermined position of an analyte of mass spectrometry. If necessary, the method includes other steps.

In the method for preparing a measurement sample for mass spectrometry, the matrix is made fly correspondingly to the regions in the base that are irradiated with the laser beam. It is thus possible to dispose the matrix on the surface of the measurement sample so that the matrix has a shape corresponding to the shape of a laser beam to be applied. In other words, it is possible to dispose the matrix at a desired position on the surface of the measurement sample by applying the laser beam to the base on which the matrix is disposed. The matrix disposed on the surface of the measurement sample are in the form of dots unless the laser beam is applied to the matrix base so that regions to be irradiated with the laser beam are continuous. Hereinafter, the matrix disposed on the surface of the measurement sample in the form of dots will be referred to as "matrix dots".

Existing methods for preparing a measurement sample for mass spectrometry use, for example, a method where a matrix is applied to a sample by a spray gun and a method where a matrix is applied to a sample through gas-phase spray or vapor deposition. In these methods, only one kind of matrix could be disposed on one measurement sample. In other words, although there are optimum matrices for components to be analyzed, the existing methods could not separately apply such optimum matrices to a plurality of components to be analyzed in one sample.

In the existing methods for preparing a measurement sample for mass spectrometry, moreover, when there are a plurality of measurement targets on a plate on which a sample of the measurement targets has been prepared, there is a need to dispose matrices corresponding to the respective measurement targets. It is therefore necessary to provide the same number of samples as the number of kinds of the measurement targets, which is inefficient.

The existing methods for preparing a measurement sample for mass spectrometry often depend on the skills of an operator. In the existing methods, diameters of crystals of a matrix tend to be uneven, which may adversely affect sensitivity or precision of analysis.

By using the method for preparing a measurement sample for mass spectrometry that disposes the matrix for mass spectrometry on the surface of the measurement sample in the form of dots, a necessary amount of the matrix can be disposed at a desired site of the measurement sample to be able to overcome the above problems in the art. Even when there is only a small amount of the measurement sample, matrices suitable for targets to be analyzed, such as a protein, a lipid, and a nucleotide, can be disposed at predetermined positions thereof. Therefore, even when there are a plurality of targets to be analyzed in one sample, it is possible to perform imaging mass spectrometry with high sensitivity for the targets to be analyzed.

<Base Including Matrix Disposed on Surface of the Base>

The base including a matrix disposed on a surface of the base is not particularly limited and may be appropriately selected depending on the intended purpose.

Hereinafter, the "base including a matrix disposed on a surface of the base" will be referred to as a "matrix plate".

The matrix plate includes a matrix and a base and, if necessary, further includes a laser energy absorbable material.

<<Matrix>>

The matrix is not particularly limited and may be appropriately selected depending on the intended purpose, as long as the matrix is a material capable of suppressing photodecomposition and thermal decomposition of a sample and suppressing fragmentation (cleavage).

Examples of the matrix include, but are not limited to, matrices known in the art such as 1,8-diaminonaphthalene (1,8-DAN), 2,5-dihydroxybenzoic acid (hereinafter may be abbreviated as "DHBA"), 1,8-anthracenedicarboxylic acid dimethyl ester, leucoquinizarin, anthrarobin, 1,5-diaminonaphthalene (1,5-DAN), 6-aza-2-thiothymine, 1,5-diaminoanthraquinone, 1,6-diaminopyrene, 3,6-diaminocarbazole, 1,8-anthracenedicarboxylic acid, norharmane, 1-pyrenepropylamine hydrochloride, 9-aminofluorene hydrochloride, ferulic acid, dithranol, 2-(4-hydroxyphenylazo)benzoic acid) (HABA), trans-2-[3-(4-tert-butylphenyl)-2-methyl-2-propenylidene]malononitrile) (DCTB), trans-4-phenyl-3-buten-2-one (TPBO), trans-3-indoleacrylic acid (IAA), 1,10-phenanthroline, 5-nitro-1,10-phenanthroline, α-cyano-4-hydroxycinnamic acid (CHCA), sinapic acid (SA), 2,4,6-trihydroxyacetophenone (THAP), 3-hydroxypicolinic acid (HPA), anthranilic acid, nicotinic acid, 3-aminoquinoline, 2-hydroxy-5-methoxybenzoic acid, 2,5-dimethoxybenzoic acid, 4,7-phenanthroline, p-coumaric acid, 1-isoquinolinol, 2-picolinic acid, 1-pyrenebutanoic acid, hydrazide (PBH), 1-pyrenebutyric acid (PBA), and 1-pyrenemethylamine hydrochloride (PMA). Of these, a matrix that is acicular-crystalized is preferable, and for example, 2,5-dihydroxybenzoic acid (DHMA) is preferable.

In the method for preparing a measurement sample for mass spectrometry, as the matrix that is to be made fly from the matrix plate including the base, one of the above various kinds of the matrices can be selected, but the matrix is preferably two or more kinds of the matrices.

Moreover, two or more kinds of the matrices that are made fly from the matrix plate including the base are preferably disposed on mutually different predetermined positions of the sample of an analyte for mass spectrometry. The above-mentioned configuration is advantageous because two or more kinds of matrices can be separately applied in one measurement sample, and two or more kinds of imaging mass spectrometry can be performed on one measurement sample.

A region in which the matrix is to be formed is not particularly limited as long as the region is present on the laser energy absorbable material, which will be described below. A shape, structure, and size thereof may be appropriately selected.

The matrix may coat the laser energy absorbable material entirely or partially.

When the matrix coats the laser energy absorbable material, a region in which the matrix is present may be referred to as a matrix layer.

The average thickness of the matrix is not particularly limited and may be appropriately selected depending on the intended purpose. For example, it is preferably 3 μm or more but 50 μm or less and more preferably 5 μm or more but 30 μm or less. When the average thickness of the matrix is 3 μm or more but 50 μm or less, it is possible to accurately deposit a sufficient amount of the matrix onto a measurement sample in a single flying operation.

<<Laser Energy Absorbable Material>>

The laser energy absorbable material is not particularly limited and may be appropriately selected depending on the intended purpose. Examples thereof include, but are not limited to, a material that is able to absorb energy of a laser beam having a wavelength of 400 nm or longer and a material having a transmittance to the wavelength of a laser beam of 60% or lower.

When the laser energy absorbable material is a material that is able to absorb energy of a laser beam having a wavelength of 400 nm or longer (which is in the visible light wavelength region), it is possible to prevent change in properties (possible damage) due to application of a high-energy laser beam to a target to be analyzed, to thereby be able to achieve MALDI mass spectrometry with small variation. As used herein, "change in properties" means changes in the structure, molecular weight, etc. of the substance of interest. Examples of methods for confirming the change in properties include, but are not limited to, a method of confirming whether the proportion of low-molecular-weight components increases through mass spectrometry.

The transmittance of the laser beam having the wavelength can be measured using a spectrophotometer such as an ultra violet-visible infrared spectrophotometer V-660 (available from JASCO Corporation).

The shape of the laser energy absorbable material is not particularly limited and may be appropriately selected depending on the intended purpose. It is preferably a thin film having an average thickness of 3 μm or less.

A material forming the laser energy absorbable material is preferably a material that is inert to the matrix and that has a surface having conductivity when forming a matrix on the laser energy absorbable material. If it is inert to the matrix, there is not a risk that the laser energy absorbable material causes a chemical reaction with the matrix upon application of the laser beam. If it has a surface having conductivity when forming a matrix on the laser energy absorbable material, the matrix can be electrostatically coated on the laser energy absorbable material. This makes it possible to form a more uniform matrix and increase the yield of matrix coating.

The material forming the laser energy absorbable material is not particularly limited and may be appropriately selected depending on the intended purpose. Examples thereof include, but are not limited to, metals.

Examples of the metals include, but are not limited to, gold, platinum palladium, and silver. Of these, gold is preferable because it is inert and absorbs a laser beam having a broad wavelength range.

When the laser energy absorbable material is a metal thin film, the average thickness thereof is preferably 20 nm or more but 200 nm or less. When the laser energy absorbable material is such a metal thin film having an average thickness of 20 nm or more but 200 nm or less, it is possible to suppress occurrence of variation in conductivity of the surface and suppress occurrence of variation in the thickness of the matrix when coating the matrix through electrostatic coating.

A method for forming the laser energy absorbable material on the base is, for example, vacuum vapor deposition or sputtering.

<<Base>>

A shape, structure, size, material, and others of the base are not particularly limited and may be appropriately selected depending on the intended purpose.

The shape of the base is not particularly limited and may be appropriately selected depending on the intended purpose, as long as the base includes a matrix on a surface thereof and a laser beam or an optical vortex laser beam, which will be described below, can be applied onto a back surface of the base. Examples of a flat-plate base include, but are not limited to, a glass slide.

The material of the base is not particularly limited and may be appropriately selected depending on the intended purpose, as long as the material of the base allows for transmission of, for example, a Gaussian laser beam, an optical vortex laser beam, or a uniformly heating irradiation laser beam. Of the materials that allow for transmission of, for example, a Gaussian laser beam, an optical vortex laser beam, or a uniformly heating irradiation laser beam, inorganic materials, such as various glass including silicon oxide as a main component, and organic materials, such as transparent heat resistance plastics and elastomers, are preferable in view of transmittance and heat resistance.

A surface roughness Ra of the base is not particularly limited and may be appropriately selected depending on the intended purpose. The surface roughness Ra is preferably 1 μm or less both on a front surface and a back surface of the base in order to suppress refraction scattering of, for example, a Gaussian laser beam, an optical vortex laser beam, or a uniformly heating irradiation laser beam, and to prevent reduction in energy to be applied to the matrix. Moreover, the surface roughness Ra in the preferable range is advantageous because unevenness in an average thickness of the matrix deposited on the sample can be suppressed, and a desired amount of the matrix can be deposited.

The surface roughness Ra can be measured according to JIS B0601. For example, the surface roughness Ra can be measured by means of a confocal laser microscope (available from KEYENCE CORPORATION) or a stylus-type surface profiler (Dektak150, available from Bruker AXS).

—Production Method of Matrix Plate—

A production method of the matrix plate is not particularly limited and may be appropriately selected depending on the intended purpose. Examples of the production method include, but are not limited to, a method where a matrix layer crystallized by a powder forming device as described below is placed on a glass slide to produce a matrix plate.

In a production method of the matrix layer, first, a matrix solution containing a matrix mixed in a solvent is prepared.

The solvent is not particularly limited and may be appropriately selected depending on the intended purpose. Examples of the solvent include, but are not limited to, TFA, TFA-acetonitrile, THF, and methanol.

Figure 1B:
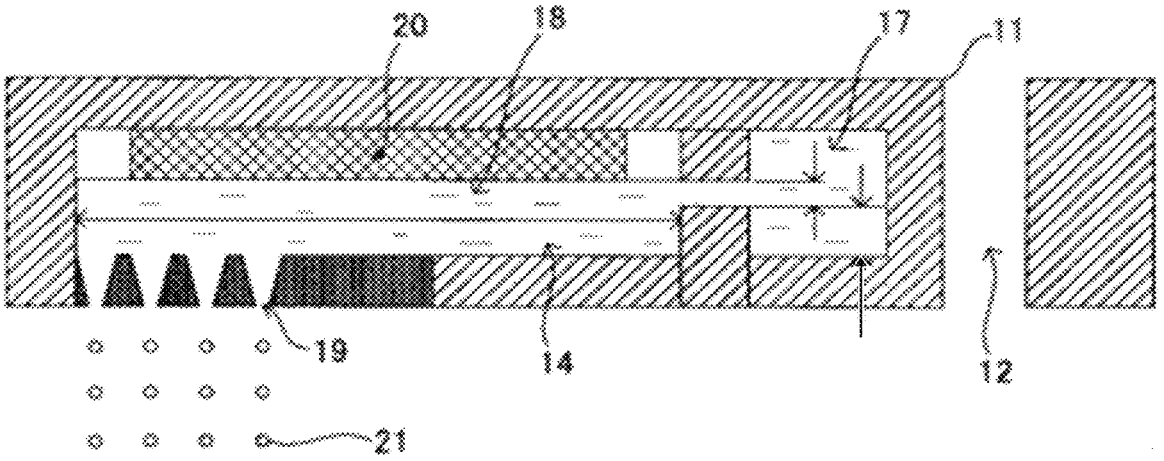
FIG. 1B is a schematic view illustrating a droplet forming head in a droplet forming unit in FIG. 1A.
Figure 1C:
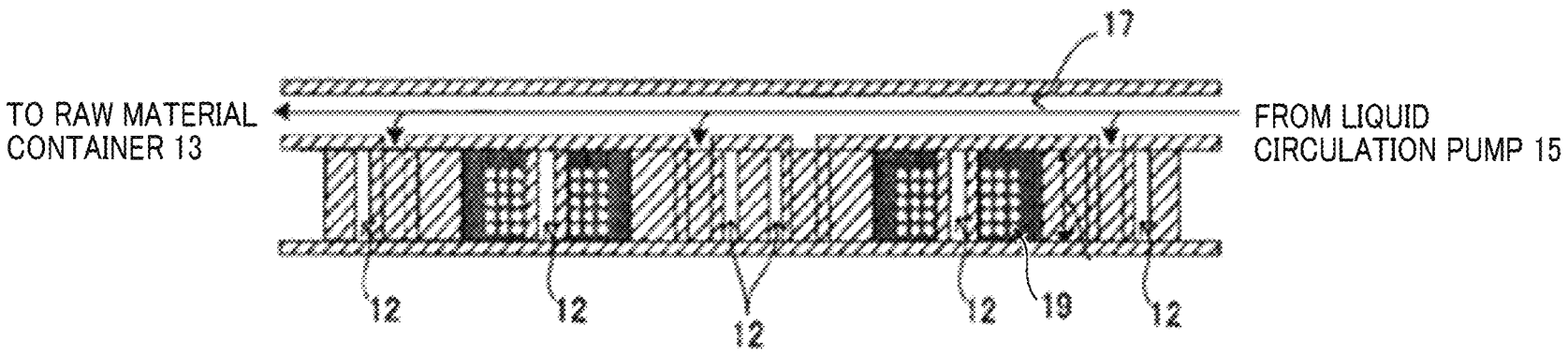
FIG. 1C is a cross-sectional view of a droplet forming unit in FIG. 1A, as taken along line A-A'.

Next, the prepared matrix solution is accommodated in a raw material container 13 of a powder forming device 1 illustrated in FIGS. 1A to 1C.

FIG. 1A is a schematic view illustrating an example of a powder forming device as a whole. FIG. 1B is a schematic view illustrating a droplet forming head in a droplet forming unit in FIG. 1A. FIG. 1C is a cross-sectional view of a droplet forming unit in FIG. 1A, as taken along line A-A'.

The powder forming device 1 illustrated in FIG. 1A includes mainly a droplet forming unit 10 and a dry collection unit 30. The droplet forming unit 10 illustrated in FIG. 1B and FIG. 1C is a liquid chamber having a liquid jetting region in communication with the outside through discharge holes, and has a plurality of droplet discharge heads 11 aligned, where the droplet discharge heads 11 are a droplet forming unit configured to jet from the discharge holes, droplets of the matrix solution inside a liquid column resonance liquid chamber in which liquid column resonance standing waves are generated under predetermined conditions. Both sides of each droplet discharge head 11 are provided with gas flow passages 12 through each of which a gas flow generated by a gas flow generating unit passes so that droplets of the matrix solution discharged from the droplet discharge head 11 are flown to the side of the dry collection unit 30. Moreover, the droplet forming unit 10 includes a raw material container 13 storing therein a matrix solution 14 that is a matrix raw material, and a liquid circulation pump 15 configured to supply the matrix solution 14 accommodated in the raw material container 13 to the below-mentioned common liquid supply path 17 inside the droplet discharge head 11 through a liquid supply tube 16, and to pump the matrix solution 14 inside the liquid supply tube 16 to return to the raw material container 13 through a liquid returning tube 22. Moreover, the droplet discharge head 11 includes the common liquid supply path 17 and a liquid column resonance liquid chamber 18, as illustrated in FIG. 1B. The liquid column resonance liquid chamber 18 is in communication with the common liquid supply path 17 provided at one of the wall surfaces at both edges in a longitudinal direction. The liquid column resonance liquid chamber 18 includes matrix discharge holes 19 disposed in one of the wall surfaces connected to the wall surfaces at both edges in the longitudinal direction and configured to discharge matrix droplets 21. The liquid column resonance liquid chamber 18 further includes a vibration generating unit 20 disposed at the wall surface facing the matrix discharge holes 19 and configured to generate high frequency vibrations for forming liquid column resonance standing waves. Note that, a high frequency power source is connected to the vibration generating unit 20.

The dry collection unit 30 illustrated in FIG. 1A includes a chamber 31 and a matrix collecting unit. Inside the chamber 31, a gas flow generated by the gas flow generating unit and a downward gas flow 33 are merged to form a large downward gas flow. Matrix droplets 21 jetted from the droplet discharge head 11 of the droplet forming unit 10 are transported downwards by the downward gas flow 33 as well as by the action of gravity, and therefore the jetted matrix droplets 21 are prevented from slowing down due to air resistance. With this configuration, variation in crystal diameters of the matrix droplets 21 is prevented, where the variation would otherwise occur when the matrix droplets 21 are continuously jetted because the traveling speed of previously-jetted matrix droplets 21 is slowed down due to air resistance and subsequently-jetted matrix droplets 21 catch up with the previously-jetted matrix droplet 21 to cause cohesion between the matrix droplets 21. The gas flow generating unit may employ a method where pressurization is performed by disposing a blower at an upstream section or a method where decompression is performed by vacuuming by a matrix collecting unit. The matrix collecting unit includes a rotary gas flow generating device configured to generate a rotary gas flow rotating around an axis parallel to the vertical direction. Powder of the dried and crystalized matrix is born on a base 201 disposed on the bottom of the chamber 31. The powder forming device 1 illustrated in FIG. 1A includes pressure gauge PG1 and pressure gauge PG2 which measure the pressure in the device.

The matrix powder obtained in the above-described manner has less variation in crystal diameters, and therefore analysis of high reproducibility becomes possible. Since the matrix powder includes almost no solvent as the solvent is evaporated by drying, biological tissue of the measurement sample is prevented from being destroyed by the solvent of the matrix solution applied to the sample, as seen in the methods known in the art by, for example, spraying. Since almost no solvent is evaporated in performing mass spectrometry, advantageously, the matrix powder can be used to perform mass spectrometry in medical fields or clinical trials, and analysis results can be obtained on-site.

Figure 1D:
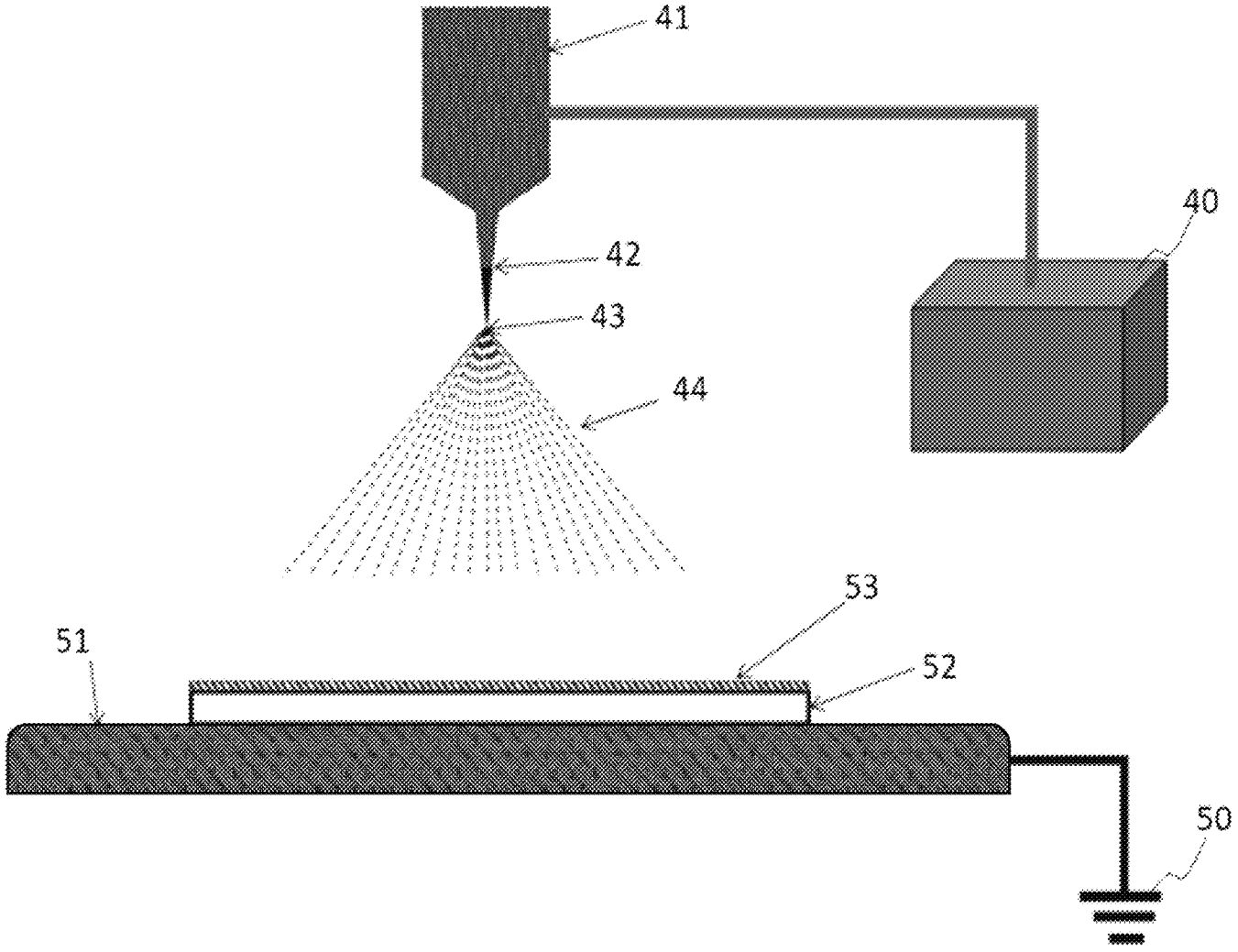
FIG. 1D is a schematic view illustrating one example of coating a matrix onto a base by an electrostatic coating method.

Another method for forming a matrix layer is suitably a method using, for example, an electrostatic coating device illustrated in FIG. 1D (MICRO MIST COATER, available from Nagase Techno-Engineering Co. Ltd.). The MICRO MIST COATER includes a power source 40, a syringe 41, an earth 50, and a coating stage 51.

The MICRO MIST COATER utilizes a phenomenon of electrospray to form a liquid into a mist. The electrospray is a phenomenon in which a voltage at several thousands of voltages is applied to a liquid in a nozzle at the tip of the syringe 41 and then discharged liquid 42 is allowed to undergo Rayleigh fission 43 to form charged droplets 44, whereby the liquid is formed into a mist. The charged liquid is finely formed into a mist through repulsion by an electrostatic force, and moves towards and adheres onto the surface of a base 52 including a laser energy absorbable material 53, which is a conductive layer.

By use of such electrostatic coating, the matrix solution formed into a fine mist or a powder thereof is attracted to the base by an electrostatic force. This makes it possible to minimize scattering of the matrix solution or the powder, leading to a considerable increase in the rate of use of the matrix solution.

Also, the mist lands on the base softly and involves no rebounding after landing, which makes it possible to form a more uniform matrix layer.

Other methods usable for forming the matrix layer are vacuum vapor deposition and sputtering. These methods are effective means for forming a uniform matrix layer.

A shape of the matrix disposed on the surface of the base is not particularly limited and may be appropriately selected depending on the intended purpose. Examples of the shape of the matrix include, but are not limited to, a single layer, a multiple layer, and dots.

When the matrix absorbs the laser having the wavelength, a single layer or dots, or both are preferable. The shape of the matrix being a single layer or dots, or both is advantageous because the matrix can be easily disposed on the surface of the sample.

In the present disclosure, in order to prevent damage to the sample caused by the laser to make the matrix fly, the matrix layer is formed on the laser energy absorbable material that absorbs the laser having such a wavelength that is not absorbed in the matrix layer.

—Method for Applying Laser Beam to Matrix Plate (Laser Beam Irradiation Unit)—

A method for applying a laser beam to the matrix plate (laser beam irradiation unit) is not particularly limited and may be appropriately selected depending on the intended purpose. For example, the method is preferably a method where a laser beam is applied to the matrix plate by the below-described laser beam irradiation unit.

Figure 2:
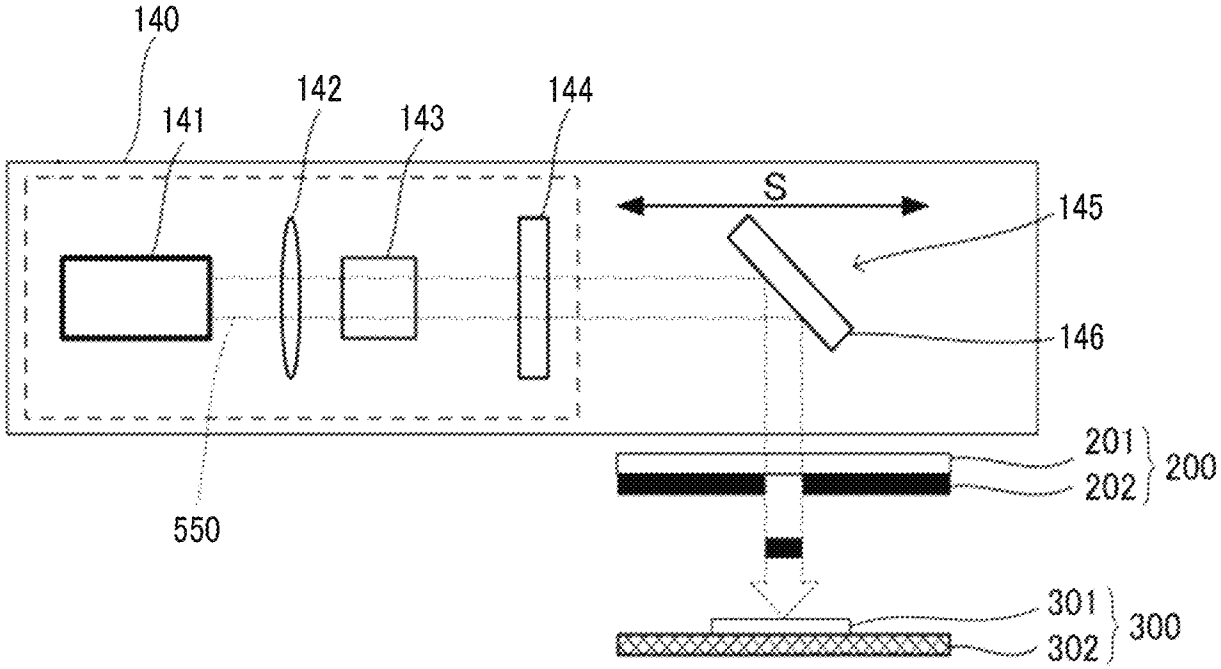
FIG. 2 is a schematic view illustrating one example of a laser beam irradiation unit that can be used in a method for preparing a measurement sample for mass spectrometry.

FIG. 2 is a schematic view illustrating an example of an optical vortex laser beam as a laser beam irradiation unit that can be used in the method of the present disclosure for preparing a measurement sample for MALDI mass spectrometry.

In FIG. 2, the laser beam irradiation unit 140 is configured to apply a laser beam 550 to a matrix 202 and a laser energy absorbable material born on a base 201, and the matrix 202 and the laser energy absorbable material are made fly by the energy of the laser beam 550 to deposit the matrix 202 on a sample section 301 on a glass slide 302.

The laser beam irradiation unit 140 includes a laser light source 141, a beam size changing unit 142, a beam wavelength changing unit 143, an energy adjusting filter 144, and a beam scanning unit 145. The matrix plate 200 includes the base 201, the matrix 202, and the laser energy absorbable material and the measurement sample 300 includes the sample section 301 and the glass slide 302.

The laser light source 141 is configured to generate and apply a pulse-oscillated laser beam 550 to the beam size changing unit 142.

Examples of the laser light source 141 include, but are not limited to, a solid laser, a gas laser, and a semiconductor laser.

The beam size changing unit 142 is disposed downstream of the laser light source 141 in an optical path of the laser beam 550 generated by the laser light source 141, and is configured to change the size of the laser beam 550.

Examples of the beam size changing unit 142 include, but are not limited to, a condenser lens.

The beam size of the laser beam 550 is not particularly limited and may be appropriately selected depending on the intended purpose. The beam size is preferably 20 m or greater but 300 μm or less. The beam size of the laser beam 550 within the preferable range is advantageous because arrangement of a matrix corresponding to a beam size of the existing MALDI becomes possible.

The beam wavelength changing unit 143 is disposed downstream of the beam size changing unit 142 in an optical path of the laser beam 550, and is configured to change the wavelength of the laser beam 550 to a wavelength that can be absorbed by the matrix 202 and the laser beam absorbable material.

In the present disclosure, the wavelength of the laser beam 550 is a wavelength that is not absorbed by the matrix 202 but is absorbed by the laser beam absorbable layer.

The beam wavelength changing unit is not particularly limited and may be appropriately selected depending on the intended purpose, as long as the total torque $J_{L,S}$ represented by the formula (1) below can satisfy the condition $|J_{L,S}|\geq 0$ when circular polarization is given to the laser beam. Examples of the beam wavelength changing unit include, but are not limited to, a quarter wave plate. In case of the quarter wave plate, oval circular polarization (elliptic polarization) may be given to an optical vortex laser beam by setting an optical axis to an angle other than +450 or −45°, but preferably, circular polarization of a true circle is given to the laser beam by setting the optical axis to +45° or −45° to satisfy the condition described above. As a result, the laser beam irradiation unit 140 can increase the effect of stably making the light-absorbing material fly to deposit the light-absorbing material on the deposition target with suppressed scattering.

$$J_{L,S} = \varepsilon_0\left\{\omega LI - \frac{1}{2}\omega Sr\frac{\partial I}{\partial r}\right\} \tag{1}$$

In the formula (1), $\varepsilon_0$ is a dielectric constant in vacuum, ω is an angular frequency of light, L is a topological charge, I is an orbital angular momentum corresponding to the degree of vortex of a laser beam represented by the following mathematical formula (2), S is a spin angular momentum corresponding to circular polarization, and r is a radius vector of the cylindrical coordinates system.

$$I(r) = r^{(2|L|)}\exp\left(-\frac{r^2}{\omega_0^2}\right) \tag{2}$$

In the formula (2), coo is a beam waist size of light.

The topological charge is a quantum number appearing from the periodic boundary condition of the orientation direction in the cylindrical coordinates system of the laser beam. The beam waist size is the minimum value of the beam size of the laser beam.

L is a parameter determined by the number of turns of the spiral wavefront in the wave plate. S is a parameter determined by the direction of circular polarization in the wave plate. L and S are both integers. The symbols L and S represent directions of spiral; i.e., clockwise and counter-clockwise, respectively.

When the total torque of the laser beam is J, the relationship J=L+S is established.

Examples of the beam wavelength changing unit 143 include, but are not limited to, KTP crystals, BBO crystals, LBO crystals, and CLBO crystals.

The energy adjusting filter 144 is disposed downstream of the beam wavelength changing unit 143 in an optical path of the laser beam 550, and is configured to transmit and convert the laser beam 550 to appropriate energy for making the matrix 202 fly. Examples of the energy adjusting filter 144 include, but are not limited to, an ND filter, and a glass plate.

The beam scanning unit 145 is disposed downstream of the energy adjusting filter 144 in an optical path of the laser beam 550, and includes a reflector 146.

The reflector 146 is movable in a scanning direction presented with an arrow S in FIG. 2 by a reflector driving unit, and is configured to reflect the laser beam 550 to an any position of the matrix 202 and the laser energy absorbable material born on the base 201.

The matrix 202 and the laser energy absorbable material are irradiated with the laser beam 550 having passed through the energy adjusting filter 144, and receive energy in the range of the size of the laser beam 550 to fly onto the sample section 301.

The laser beam 550 is not particularly limited and may be appropriately selected depending on the intended purpose. Examples of the laser beam include, but are not limited to, an optical vortex laser beam, a uniformly heating irradiation laser beam, and a Gaussian laser beam. Of these, an optical vortex laser beam or a uniformly heating irradiation laser beam is preferable because the optical vortex laser beam has such properties that can enhance robustness of conditions for transferring a matrix to a sample without scattering the matrix. The laser beam 550 being an optical vortex laser beam is advantageous because the matrix 202 and the laser energy absorbable layer after flying adhere to the sample section 301 while being suppressed from scattering therearound by virtue of the Gyroscopic effect given by the optical vortex laser beam.

Conversion to the optical vortex laser beam can be achieved using, for example, a diffractive optical element, a multimode fiber, or a liquid crystal phase modulator.

The laser beam 550 being a uniformly heating irradiation laser beam is advantageous because the matrix 202 and the laser energy absorbable layer after flying adhere to the sample section 301 while being suppressed from scattering therearound.

——Optical Vortex Laser Beam——

Referring to the simulation images of FIG. 3 and FIG. 4, differences between the Gaussian beam and the optical vortex laser beam will be described.

Figure 3A:
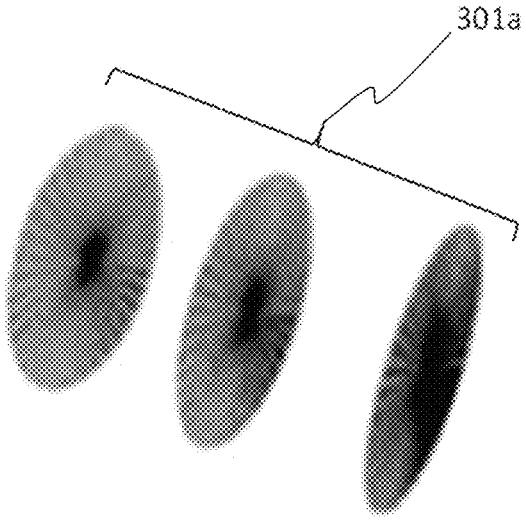
FIG. 3A is a schematic view illustrating one example of a wavefront (equiphase surface) of a typical laser beam.
Figure 3B:
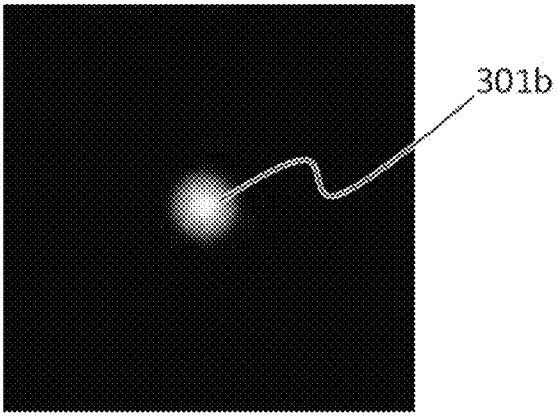
FIG. 3B is a view illustrating one example of a light intensity distribution of a typical laser beam.
Figure 3C:
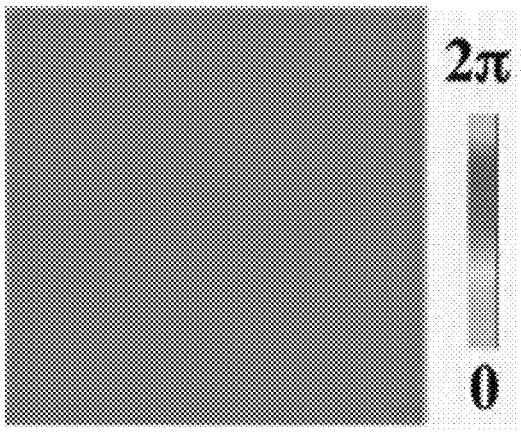
FIG. 3C is a view illustrating one example of a phase distribution of a typical laser beam.

FIG. 3A is one example of an image representing the energy intensity of the Gaussian beam. Since a typical laser beam has uniform phases, the laser beam has a planar equiphase surface (wavefront) 301*a* as illustrated in FIG. 3A. The direction of the pointing vector of the laser beam is the orthogonal direction of the planar equiphase surface. Accordingly, the direction of the pointing vector of the laser beam is identical to the irradiation direction of the laser beam. When the light-absorbing material is irradiated with the laser beam, therefore, a force acts on the light-absorbing material in the irradiation direction. FIG. 3B is one example of an image representing the intensity distribution of the typical laser beam in the cross-section in the orthogonal direction to the irradiation direction. The light intensity distribution 301*b* in the cross-section of the layer beam is a normal distribution (Gaussian distribution) where light intensity is the maximum at the center of the beam as illustrated in FIG. 3B. Therefore, the light-absorbing material tends to be scattered. FIG. 3C is one example of an image representing one example of the phase distribution of the typical laser beam. Observation of the phase distribution confirms that there is no phase difference as illustrated in FIG. 3C.

Figure 4A:
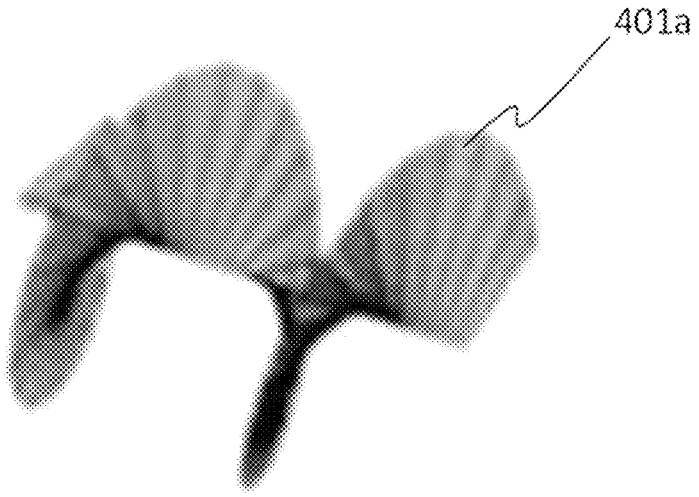
FIG. 4A is a schematic view illustrating one example of a wavefront (equiphase surface) of an optical vortex laser beam.
Figure 4B:
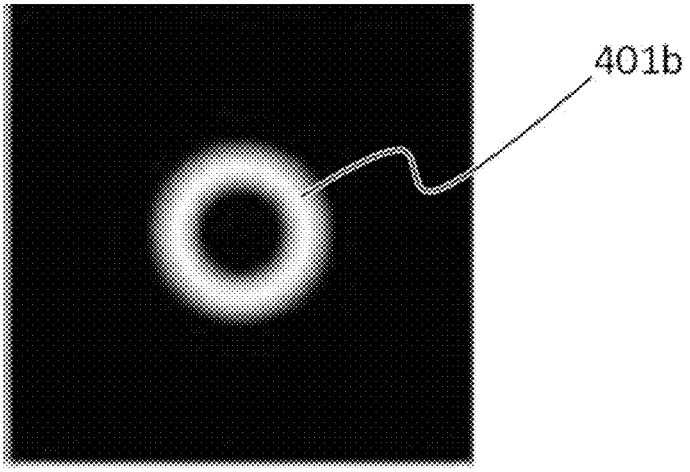
FIG. 4B is a view illustrating one example of a light intensity distribution of an optical vortex laser beam.
Figure 4C:
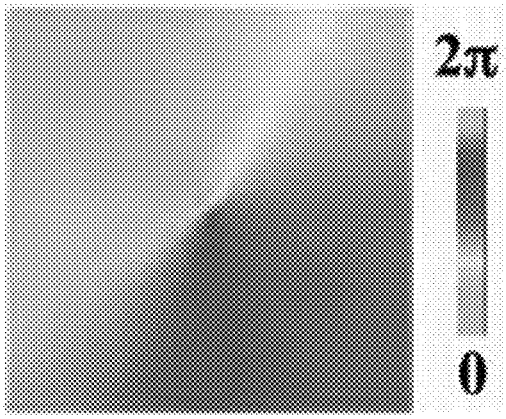
FIG. 4C is a view illustrating one example of a phase distribution of an optical vortex laser beam.

FIG. 4A is one example of an image representing the energy intensity of the optical vortex laser beam. The optical vortex laser beam has a spiral equiphase surface 401*a* as illustrated in FIG. 4A. The direction of the pointing vector of the optical vortex laser beam is a direction orthogonal to the spiral equiphase surface. When the light-absorbing material is irradiated with the optical vortex laser beam, a force acts in the orthogonal direction. FIG. 4B is one example of an image representing the intensity distribution of the optical vortex laser beam in the cross-section in the orthogonal direction to the irradiation direction. The light intensity distribution 401*b* is a doughnut-shaped distribution where the center of the beam is zero and recessed as illustrated in FIG. 4B. The doughnut-shaped energy is applied as radiation pressure to the light-absorbing material irradiated with the optical vortex laser beam. As a result, the light-absorbing material irradiated with the optical vortex laser beam is made fly in the irradiation direction of the optical vortex laser beam and is then deposited on a deposition target with a less degree of scattering. FIG. 4C is one example of an image representing one example of the phase distribution of the optical vortex laser beam. Observation of the phase distribution confirms that a phase difference occurs as illustrated in FIG. 4C.

A method for determining whether the laser beam is an optical vortex laser beam is not particularly limited and may be appropriately selected depending on the intended purpose. Examples of the method include, but are not limited to, observation of the above-described phase distribution, and measurement of interference. The measurement of interference is typically used.

The measurement of interference can be performed using a laser beam profiler (e.g., a laser beam profiler available from Ophir-Spiricon, Inc., or a laser beam profiler available from Hamamatsu Photonics K.K.). Examples of the results of the measurement of interference are illustrated in FIGS. 5A and 5B.

Figure 5A:
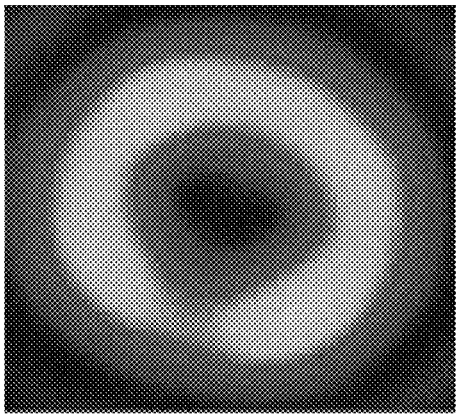
FIG. 5A is an explanatory view illustrating an example of a result of measurement of interference in an optical vortex laser beam.

FIG. 5A is an explanatory view illustrating one example of a result of measurement of interference in an optical vortex laser beam. FIG. 5B is an explanatory view illustrating one example of a result of measurement of interference in a laser beam having a point of light intensity of 0 at the center thereof.

Figure 5B:
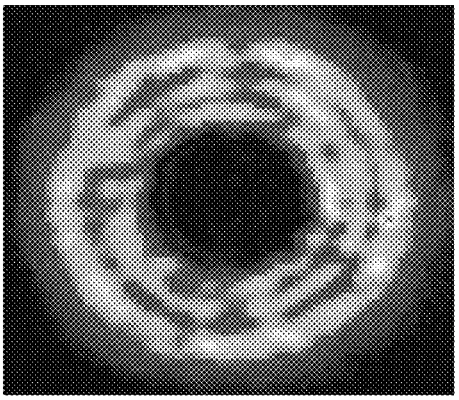
FIG. 5B is an explanatory view illustrating an example of a result of measurement of interference in a laser beam having a point of light intensity of 0 at the center thereof.

It can be confirmed from the measurement of interference in the optical vortex laser beam that the energy distribution is a doughnut shape as illustrated in FIG. 5A, and the optical vortex laser beam is a laser beam having a point of light intensity of 0 at the center thereof, similar to FIG. 5B.

On the other hand, the measurement of interference in the typical laser beam having a point of light intensity of 0 at the center thereof gives a difference from the optical vortex laser beam. Specifically, the doughnut-shaped energy distribution of the typical laser beam is not uniform as illustrated in FIG. 5B although it is similar to the energy distribution obtained by the measurement of interference in the optical vortex laser beam illustrated in FIG. 5A. In the case of using the optical vortex laser beam, the resultant matrix dot may be perforated in a doughnut-shape at the center of the dot.

The laser beam 550 being an optical vortex laser beam is advantageous because the flying matrix 202 is deposited on the sample section while being suppressed from scattering therearound by virtue of the Gyroscopic effect given by the optical vortex laser beam.

Conversion to the optical vortex laser beam can be achieved using, for example, a diffractive optical element, a multimode fiber, or a liquid crystal phase modulator.

——Uniformly Heating Irradiation Laser Beam——

Next, the uniformly heating irradiation laser beam will be described below.

The uniformly heating irradiation laser beam is a laser beam that causes a uniformly heated region exhibiting an almost uniform temperature distribution equal to or higher than the melting point of a flying target material (the laser energy absorbable material and the matrix) at the interface between the base and the flying target material (the laser energy absorbable material and the matrix).

By applying a laser beam so as to cause a region exhibiting a temperature equal to or higher than the melting point of a flying target material (the laser energy absorbable material) at the interface between the base and the flying target material (in particular, the laser energy absorbable material), a binding force (intermolecular force) at the interface between the base and the flying target material decreases, so that the flying target material is made fly as powder or debris.

Here, the phenomenon of "causing a uniformly heated region exhibiting an almost uniform temperature distribution equal to or higher than the melting point of a flying target material at the interface between the base and the flying target material" in the uniformly heating irradiation laser beam will be described in detail referring to some of the drawings.

The "uniformly heated region" means a region where the temperature distribution of the flying target material becomes almost uniform.

The "region where the temperature distribution of the flying target material becomes almost uniform" means a region of the flying target material disposed on the base where the temperature of the flying target material is uniform and becomes almost the same.

When the flying target material is a homogeneous material, it is preferable that the temperature (energy) distribution of the laser beam to be applied become almost uniform, in order to cause the "region where the temperature distribution of the flying target material becomes almost uniform". The temperature (energy) distribution of the laser beam to be applied being almost uniform will be described referring to some of the drawings. In the following, a laser beam where the temperature (energy) distribution of the laser beam to be applied is almost uniform may be referred to as a "uniformly heating irradiation laser beam".

Figure 6A:
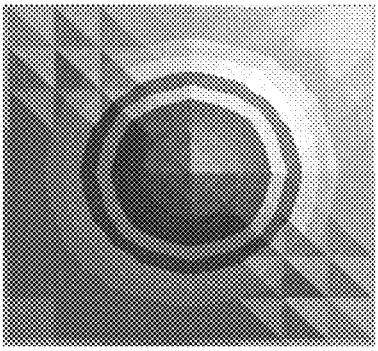
FIG. 6A is a view illustrating one example of a simulation image in which a temperature (energy) distribution of a Gaussian laser beam is represented by contour lines.
Figure 7:
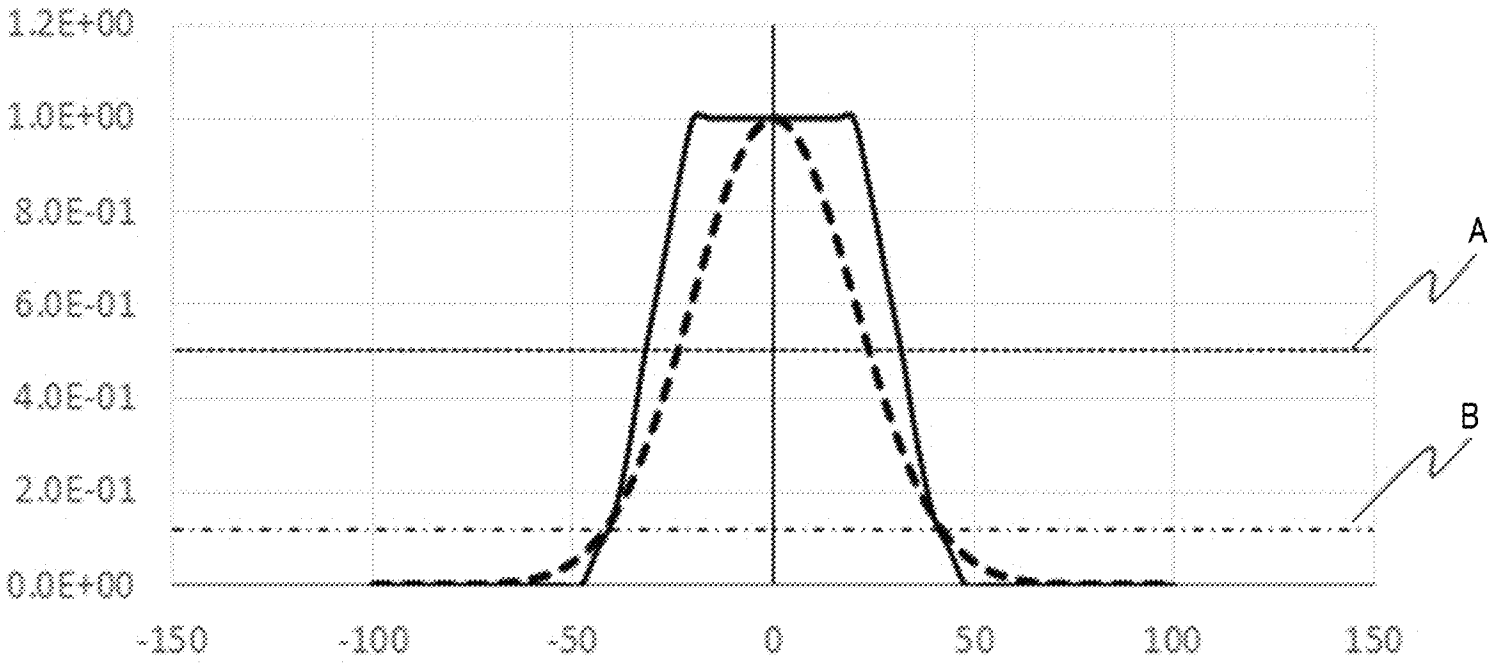
FIG. 7 is a view illustrating one example of cross-sectional intensity distributions of a Gaussian laser beam (a dotted line) and a uniformly heating irradiation laser beam (a solid line)

FIG. 6A is a view illustrating one example of a simulation image in which the temperature (energy) distribution of a commonly used Gaussian laser beam in the cross section perpendicular to the traveling direction of the laser beam is represented by contour lines. As illustrated in FIG. 6A, the Gaussian laser beam has a temperature (energy) distribution where the highest energy intensity is at the center (optical axis) of the laser beam and the energy intensity becomes lower towards the periphery in the cross section perpendicular to the traveling direction of the laser beam. FIG. 7 is a view illustrating one example of energy intensity distributions of the Gaussian laser beam (a dotted line) and the uniformly heating irradiation laser beam (a solid line) in the cross section perpendicular to the traveling direction of the laser beam. Like in FIG. 6A, it is found from FIG. 7 that for the Gaussian laser beam (a dotted line), the energy intensity is the maximum value at the center (optical axis) of the laser beam and the energy intensity becomes lower towards the periphery. Incidentally, the "energy intensity distribution of the laser beam in the cross section perpendicular to the traveling direction of the laser beam" may be referred to simply as a "cross-sectional intensity distribution of the laser beam".

Figure 6B:
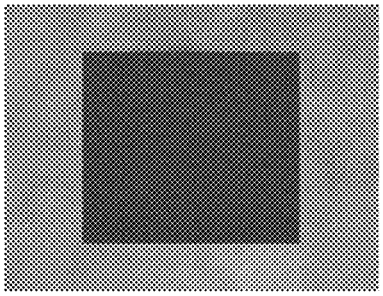
FIG. 6B is a view illustrating one example of an image representing a temperature (energy) distribution of a uniformly heating irradiation laser beam.

FIG. 6B is a view illustrating one example of an image representing the temperature (energy) distribution of the uniformly heating irradiation laser beam. As illustrated in FIG. 6B, in the uniformly heating irradiation laser beam, a region with energy (a black region in the figure) and a region without energy (a gray region in the figure) are clearly divided. Also, as illustrated in FIG. 7, it is found that the uniformly heating irradiation laser beam (a solid line) has an energy intensity distribution where the energy intensity of the laser beam is almost the same, differing from the Gaussian laser beam where the maximum value of energy is at the optical axis. Incidentally, a laser beam having a cross-sectional intensity distribution where the energy intensity of the laser beam is almost the same as described above may be referred to as a top-hat laser beam.

Hitherto, it is known that a top-hat laser beam is used for laser patterning of a thin film, but application of the top-hat laser beam in the LIFT method is not known (see, for example, Japanese Unexamined Patent Application Publication No. 2012-143787).

It is preferable that in the uniformly heating irradiation laser beam, the energy intensity of the laser beam be the same. Specifically, a preferable laser beam is a laser beam whose energy is almost uniform (almost constant) in the cross section perpendicular to the traveling direction of the laser beam.

Figure 8A:
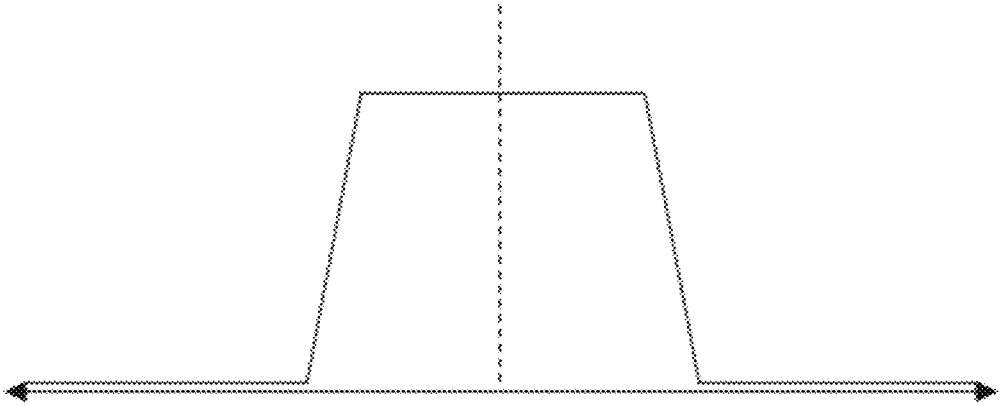
FIG. 8A is a schematic view illustrating one example of a cross-sectional intensity distribution of a uniformly heating irradiation laser beam.
Figure 8B:
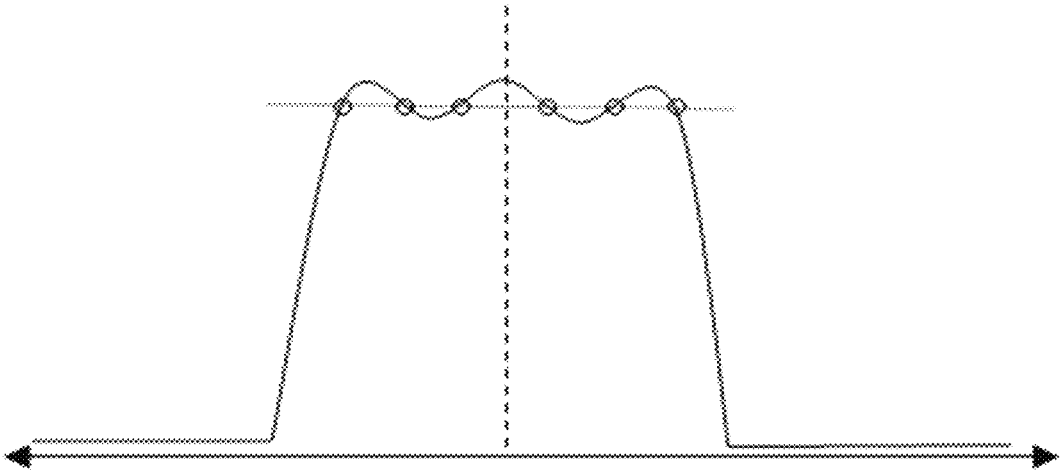
FIG. 8B is a schematic view illustrating another example of a cross-sectional intensity distribution of a uniformly heating irradiation laser beam.

Here, FIG. 8A is a schematic view illustrating one example of the cross-sectional intensity distribution of the uniformly heating irradiation laser beam. FIG. 8B is a schematic view illustrating another example of the cross-sectional intensity distribution of the uniformly heating irradiation laser beam. As illustrated in FIG. 8A, for example, a preferable uniformly heating irradiation laser beam appears to have the same energy intensity of the laser beam in the cross section perpendicular to the traveling direction of the laser beam. In reality, however, the energy intensity of the laser beam will not completely be constant as illustrated in FIG. 8A. Rather, as illustrated in FIG. 8B, the values of the energy intensity of the laser beam fluctuate, presenting an energy distribution that appears to be undulating. In this way, the uniformly heating irradiation laser beam has three or more points where the energy intensity of the uniformly heating irradiation laser beam is the same in the cross section perpendicular to the traveling direction of the laser beam. For example, in the cross-sectional intensity distribution of the uniformly heating irradiation laser beam illustrated in FIG. 8B, there are six points where the energy intensity of the laser beam is the same. Meanwhile, in the cross-sectional intensity distribution of a preferable Gaussian laser beam illustrated in FIG. 7, the distribution of its energy intensity is a Gaussian distribution, and there are at most only two points where the energy intensity of the laser beam is the same.

Therefore, a laser beam having three or more points where the energy intensity of the laser beam in the cross-sectional intensity distribution of the laser beam is the same can be said otherwise as a laser beam whose energy distribution is almost uniform. In the present disclosure, the uniformly heating irradiation laser beam that forms the "uniformly heated region" means a laser beam having three or more points where the energy intensity of the laser beam is the same in the cross-sectional intensity distribution of the laser beam.

Whether a laser beam is the uniformly heating irradiation laser beam can be determined by measuring the energy distribution of a laser beam to be applied using a beam profiler, and determining whether there are three points or more where the energy intensity of the laser beam is the same in the cross-sectional intensity distribution of the laser beam.

Next, advantages obtained by performing the LIFT method using the uniformly heating irradiation laser beam will be described referring to some of the drawings.

Figure 9A:
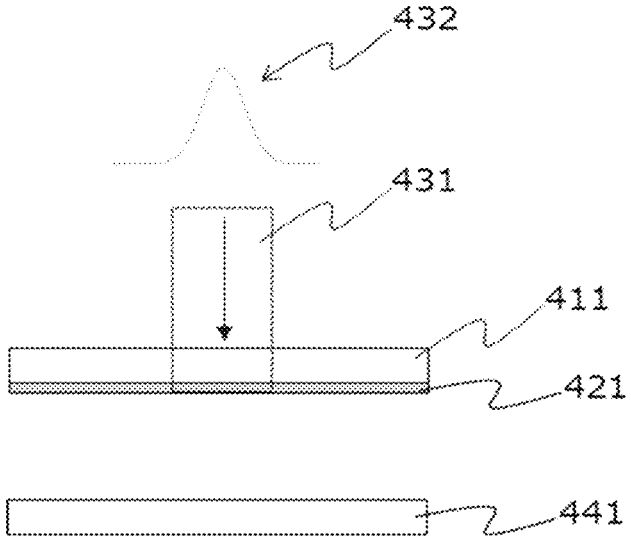
FIG. 9A is a schematic view illustrating one example of a LIFT method using an existing Gaussian laser beam.
Figure 9B:
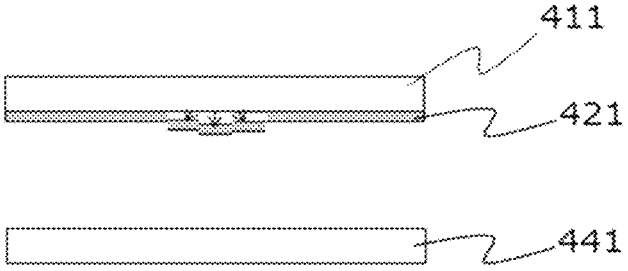
FIG. 9B is a schematic view illustrating another example of a LIFT method using an existing Gaussian laser beam.
Figure 9C:
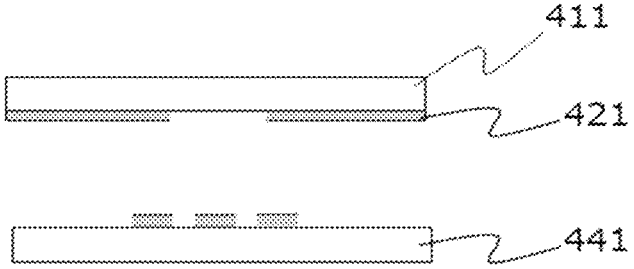
FIG. 9C is a schematic view illustrating still another example of a LIFT method using an existing Gaussian laser beam.
Figure 9D:
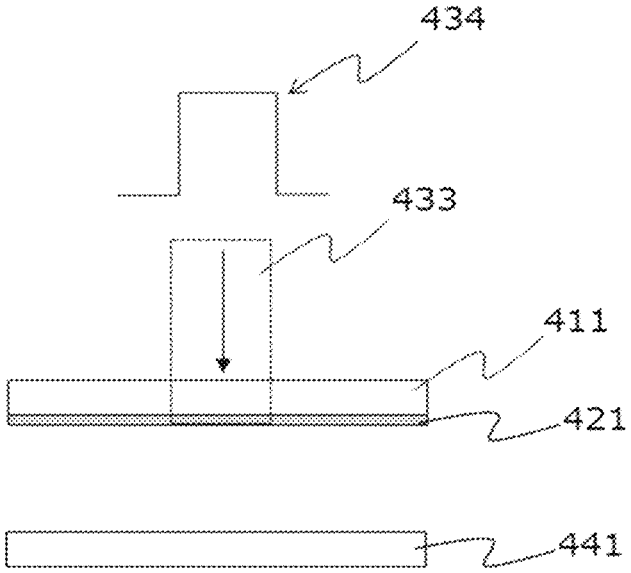
FIG. 9D is a schematic view illustrating one example of a LIFT method using a uniformly heating irradiation laser beam in the present disclosure.
Figure 9E:
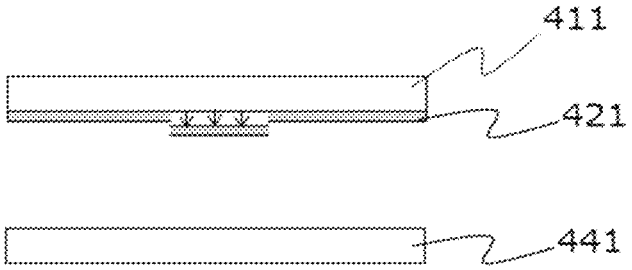
FIG. 9E is a schematic view illustrating another example of a LIFT method using a uniformly heating irradiation laser beam in the present disclosure.
Figure 9F:
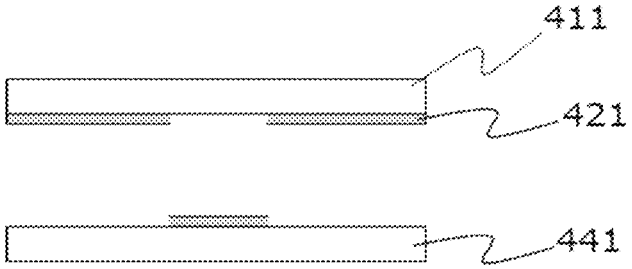
FIG. 9F is a schematic view illustrating still another example of a LIFT method using a uniformly heating irradiation laser beam in the present disclosure.

FIG. 9A to FIG. 9C are schematic views each illustrating one example of the LIFT method using the existing Gaussian laser beam. FIG. 9D to FIG. 9F are schematic views each illustrating one example of the LIFT method using the uniformly heating irradiation laser beam in the present disclosure. In FIG. 9A to FIG. 9F, a transparent base 411 is used as the base and a solid film 421 is used as the flying target material.

FIG. 9A is a schematic view illustrating one example of the case of applying a Gaussian laser beam 431 to the base 411 from the side of a surface of the base opposite to the surface thereof provided with the flying target material 421, which is disposed on an at least part of the surface of the base 411. As illustrated in FIG. 9A, when the Gaussian laser beam 431 is applied from the side of the surface of the base opposite to the surface thereof provided with the flying target material 421, the Gaussian laser beam 431 is applied to the flying target material 421 through the base 411. When the Gaussian laser beam 431 is applied to the flying target material 421, the flying target material 421 is heated to a temperature equal to or higher than the melting point thereof by the energy of the laser beam to decrease the binding force (intermolecular force) at the interface between the base 411 and the flying target material 421.

The cross-sectional intensity distribution 432 of the Gaussian laser beam 431 is that the maximum value is at the center of the Gaussian laser beam 431 and the intensity gradually becomes lower towards the periphery. As illustrated in FIG. 9B, therefore, a force tends to be easily generated in the flying target material 421 in a direction from the center of the Gaussian laser beam 431 towards the outside. As a result, as illustrated in FIG. 9C, the flying target material 421 is scattered during flying to adhere to a target 441 sparsely.

FIG. 9D is a schematic view illustrating one example of the case of applying a uniformly heating irradiation laser beam 433 to the base 411 from the side of a surface of the base opposite to the surface thereof provided with the flying target material 421, which is disposed on an at least part of the surface of the base 411.

Also in the case of the uniformly heating irradiation laser beam like in the case of the Gaussian laser beam, the laser beam is applied to the flying target material 421 through the base 411, and the flying target material 421 is heated to a temperature equal to or higher than the melting point thereof by the energy of the laser beam to decrease the binding force at the interface between the base 411 and the flying target material 421. In the present disclosure, however, the laser beam is applied so as to form a uniformly heated region in the flying target material 421. Specifically, as described above, the uniformly heating irradiation laser beam 433 whose cross-sectional intensity distribution 434 is almost uniform is applied to the flying target material 421. As illustrated in FIG. 9E, a force arises in the flying target material 421 in the same direction as the direction in which the uniformly heating irradiation laser beam 433 is applied. As a result, as illustrated in FIG. 9F, the flying target material 421 flies in the same direction as the direction in which the laser beam is applied, so that the flying target material 421 can adhere to the target 441 without scattering.

Some of the indicators representing the size (width) of a laser beam are "full width at half maximum (FWHM)" and "$1/e^2$ width".

The "full width at half maximum (FWHM)" means the width of a spectrum of a laser beam at half the maximum intensity of the laser beam (e.g., in FIG. 7, the width of the spectrum at an intensity of A).

The "$1/e^2$ width" means an indicator of regarding as a laser beam size (diameter) the distance between two points of the intensity values corresponding to 13.5% of the maximum intensity in the cross-sectional intensity distribution of the laser beam (e.g., in FIG. 7, the width of the spectrum at an intensity of B).

When a ratio of the "full width at half maximum (FWHM)" to the "$1/e^2$ width" is ho (FWHM/($1/e^2$ width)), the ho is "0.6" in a preferable Gaussian laser beam and the ho is "1" in a preferable top-hat beam.

In the case of the Gaussian laser beam, as the energy intensity of the laser beam is higher, an irradiated area at that intensity becomes smaller. Also, the intensity of the Gaussian laser beam becomes higher at a position closer to the center of the laser beam. In other words, the Gaussian laser beam is not uniform in energy intensity in an irradiated region.

Meanwhile, in the uniformly heating irradiation laser beam; i.e., the top-hat beam having the maximum intensity, the ratio ho (FWHM/($1/e^2$ width)) of the "full width at half maximum (FWHM)" to the "$1/e^2$ width" is theoretically "1". The energy intensity of the laser beam is almost uniform in an irradiated region ("$1/e^2$ width").

According to the present inventors, a laser beam is preferably applied to the flying target material so that the ratio ho (FWHM/($1/e^2$ width)) of the full width at half maximum (FWHM) to the $1/e^2$ width in the energy intensity distribution of the laser beam in the cross section perpendicular to the traveling direction of the laser beam satisfies $0.6<ho<1$ and more preferably $0.7\leq ho\leq 0.9$. The ho (FWHM/($1/e^2$ width) of the uniformly heating irradiation laser beam illustrated in FIG. 6B above was found to be 0.85.

In the cross section perpendicular to the traveling direction of the laser beam, a shape of the energy intensity distribution of the uniformly heating irradiation laser beam when the $1/e^2$ width is assumed to be a bottom side is not particular limited and may be appropriately selected depending on the intended purpose. Examples thereof include a square, a rectangle, a parallelogram, a circle, and an oval.

A method for generating the uniformly heating irradiation laser beam is not particular limited and may be appropriately selected depending on the intended purpose. For example, the uniformly heating irradiation laser beam is generated by a uniformly heating irradiation laser beam converting unit.

The uniformly heating irradiation laser beam converting unit is not particularly limited as long as it can causes the above-described uniformly heated region. Examples thereof include an aspherical lens, a phase mask such as a diffractive optical element (DOE), and phase shifting units such as a spatial light modulator (SLM). These may be used alone or in combination.

A method using the aspherical lens is a method geometrically converting the Gaussian laser beam to the uniformly heating irradiation laser beam.

Figure 10A:
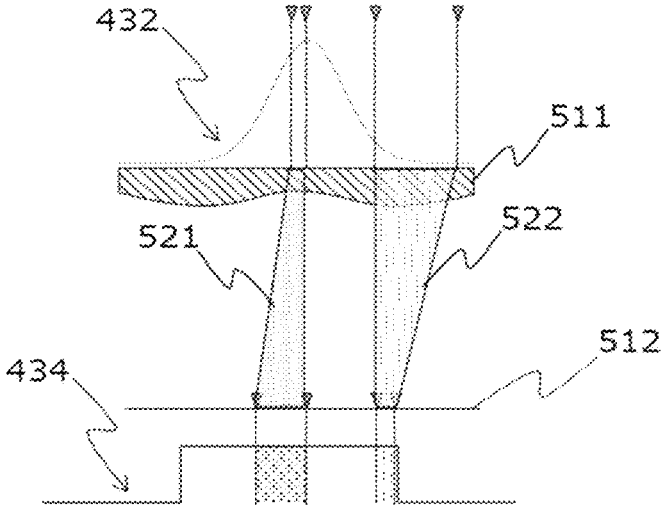
FIG. 10A is a schematic view illustrating one example of adjustment of a uniformly heating irradiation laser beam by a geometric method using an aspherical lens.

FIG. 10A is a schematic view illustrating one example of adjustment of the uniformly heating irradiation laser beam by a geometric method using an aspherical lens. As illustrated in FIG. 10A, a Gaussian laser beam is passed through an aspherical lens 511 to enlarge the central part 521 of a laser beam having a cross-sectional intensity distribution 432 of the Gaussian laser beam by the effect of a concave lens. A peripheral part 522 of the laser beam is condensed by the effect of a convex lens. On an irradiated surface (base) 512, a laser beam having a cross-sectional intensity distribution 434 of the uniformly heating irradiation laser beam can be provided.

A method using the phase mask such as the diffractive optical element (DOE) is a method wave-optically converting the Gaussian beam to the uniformly heating irradiation laser beam.

Figure 10B:
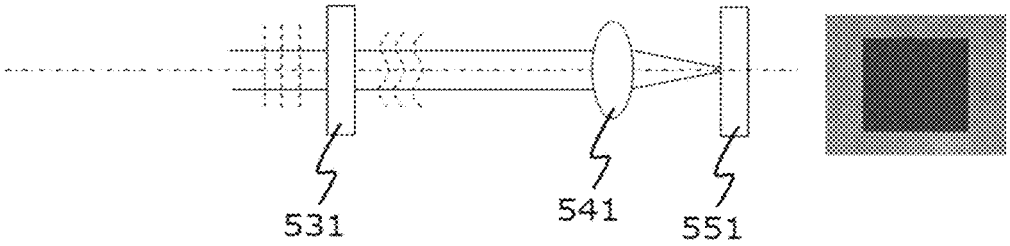
FIG. 10B is a schematic view illustrating one example of adjustment of a uniformly heating irradiation laser beam by a wave optical method using a DOE.

FIG. 10B is a schematic view illustrating one example of adjustment of the uniformly heating irradiation laser beam by a wave optical method using the DOE. As illustrated in FIG. 10B, the Gaussian beam is passed through a DOE 531 to give a central portion of the laser beam a phase distribution causing the effect of a concave lens and give a peripheral portion of the laser beam a phase distribution causing the effect of a convex lens, to be able to control the wavefront to generate the uniformly heating irradiation laser beam. The uniformly heating irradiation laser beam is condensed via a condenser lens 541 to a base 551.

A method using the phase shifting unit such as the spatial light modulator (SLM) can shift the phase distribution of the laser beam (temporal spatial light modulation). A wavefront of superimposed wavefronts may be changed temporally.

Another usable example than the above is a combination of a reflection-type liquid crystal phase shifting element and a prism.

Figure 10C:
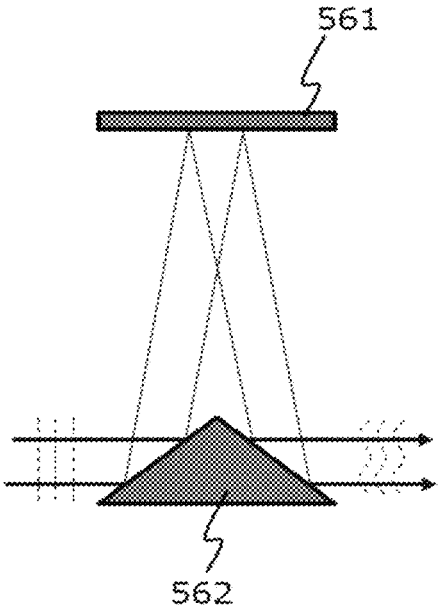
FIG. 10C is a schematic view illustrating one example of adjustment of a uniformly heating irradiation laser beam by a combination of a reflection-type liquid crystal phase shifting element and a prism.

FIG. 10C is a schematic view illustrating one example of adjustment of the uniformly heating irradiation laser beam by the combination of a reflection-type liquid crystal phase shifting element 561 and a prism 562.

By the laser beam converting optical system and the fθ lens, conversion to the uniformly heating irradiation laser beam is performed and the uniformly heating irradiation laser beam is applied onto the flying target material. The size of the laser beam applied onto the base (diameter, $1/e^2$ width) is preferably 20 μm or more but 200 μm or less and more preferably 30 μm or more but 150 μm or less.

When the size of the laser beam is 20 μm or more but 200 μm or less, quality maintenance by laser scanning is made possible to enable high-resolution two- or three-dimensional printing.

Regarding the energy of the uniformly heating irradiation laser beam, the fluence $F_B$ (J/cm$^2$) of the laser beam on the surface on which the flying targeting material is disposed is preferably 20% or higher, more preferably 20% or higher but 80% or lower, of the fluence $F_F$ (J/cm$^2$) of the laser beam on the surface of the base onto which the laser beam is applied.

The fluence (J/cm$^2$) usually refers to a fluence on the incident side (front-side fluence, $F_F$) and is often discussed with the absorption coefficient of a material. According to the studies by the present inventors, however, it is found to be preferable for flying quality to control the fluence on the film surface opposite to the light-absorbing film irradiated with light (back-side fluence, $F_B$).

Referring to some of the drawings, the method for preparing a measurement sample for mass spectrometry will be described.

Specifically, referring to FIG. 11A to FIG. 11D, the method for preparing a measurement sample for mass spectrometry will be described.

Figure 11A:
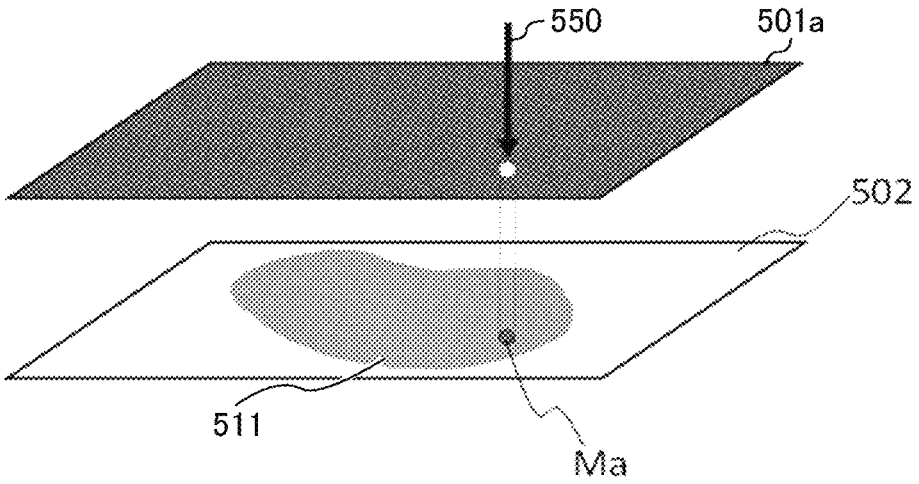
FIG. 11A is a schematic view illustrating one example of a method for preparing a measurement sample for mass spectrometry.
Figure 11B:
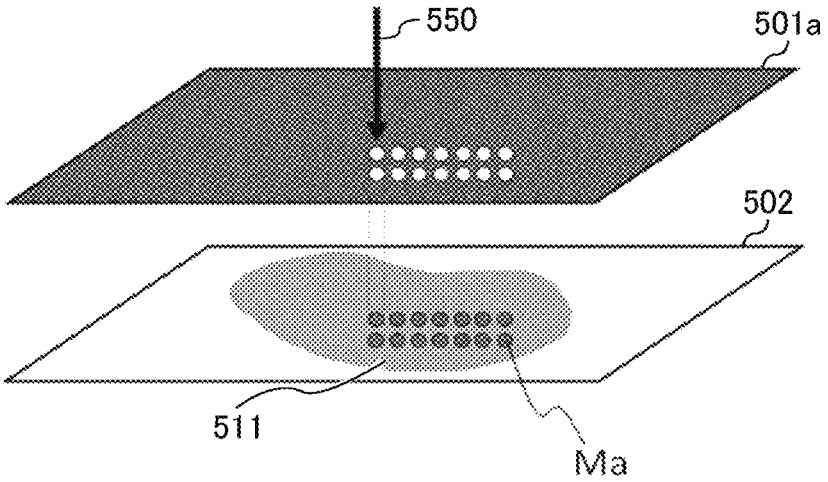
FIG. 11B is a schematic view illustrating another example of a method for preparing a measurement sample for mass spectrometry.

FIG. 11A is a conceptual view illustrating one example of the method for preparing a measurement sample for mass spectrometry. In order to dispose a matrix for mass spectrometry onto a measurement sample, a matrix plate 501*a*, where matrix A has been disposed, is set over a glass slide 502 having a measurement sample 511 so that the surface thereof where the matrix A has been disposed faces the measurement sample. A laser beam 550 is applied to a surface of the matrix plate 501*a* where the matrix A is not disposed, to make the matrix A fly to dispose the matrix A on the surface of the measurement sample 511, whereby matrix dot Ma is formed. This procedure can be repeated to form a plurality of matrix dots Ma on the surface of the measurement sample 511, as illustrated in FIG. 11B.

Figure 11C:
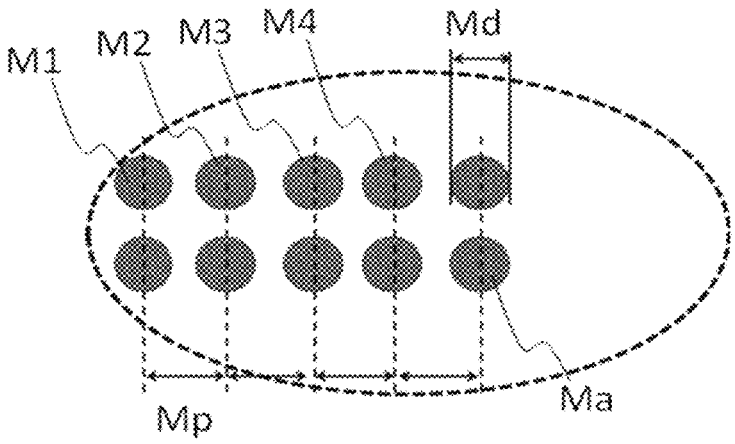
FIG. 11C is a schematic view illustrating still another example of a method for preparing a measurement sample for mass spectrometry.

The plurality of matrix dots Ma are formed on the surface of the measurement sample 511 one by one for irradiation of the laser beam. For example, as illustrated in FIG. 11C, each dot can be independently disposed as in matrix dots M1 to M4. A measurement sample for mass spectrometry obtained by the method for preparing a measurement sample for mass spectrometry includes a region where the matrix is disposed and a region where the matrix is not disposed. The diameter of the matrix dot Ma will be referred to as Md, and the center-to-center distance of the matrix dots M will be referred to as matrix pitch Mp.

Figure 11D:
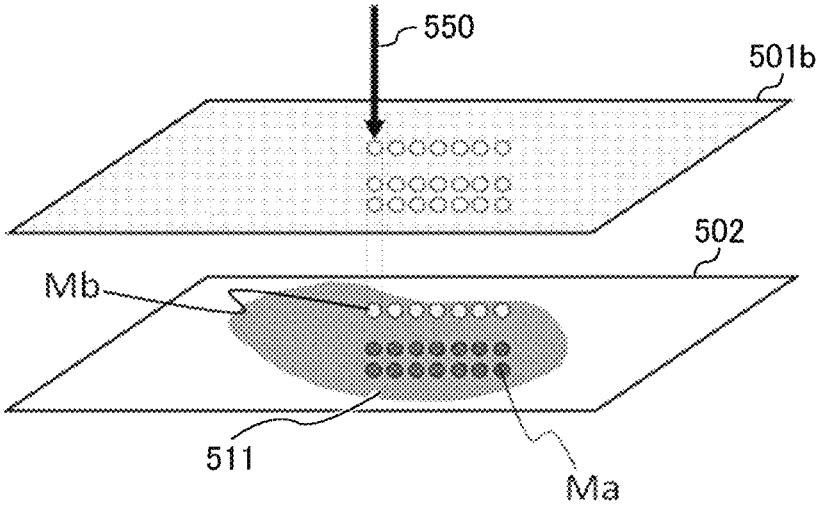
FIG. 11D is a schematic view illustrating yet another example of a method for preparing a measurement sample for mass spectrometry.

In the method for preparing a measurement sample for mass spectrometry, the matrix can be disposed at any position of a measurement sample depending on the irradiation position of the laser beam. For example, as illustrated in FIG. 11D, for the measurement sample for mass spectrometry where the matrix dots Ma of the matrix A have been formed, a matrix plate 501*b*, where matrix B of a different kind of material from the matrix A has been disposed, is used, matrix dots Mb of the matrix B can be disposed in the region on the measurement sample where the matrix dots Ma are not disposed.

The method for preparing a measurement sample for mass spectrometry as described above can prepare a measurement sample including matrix dots for mass spectrometry that are disposed on the surface of the measurement sample.

Next, an embodiment of the flying object generating device configured to perform the method for preparing the measurement sample for mass spectrometry will be described referring to some of the drawings.

Figure 15A:
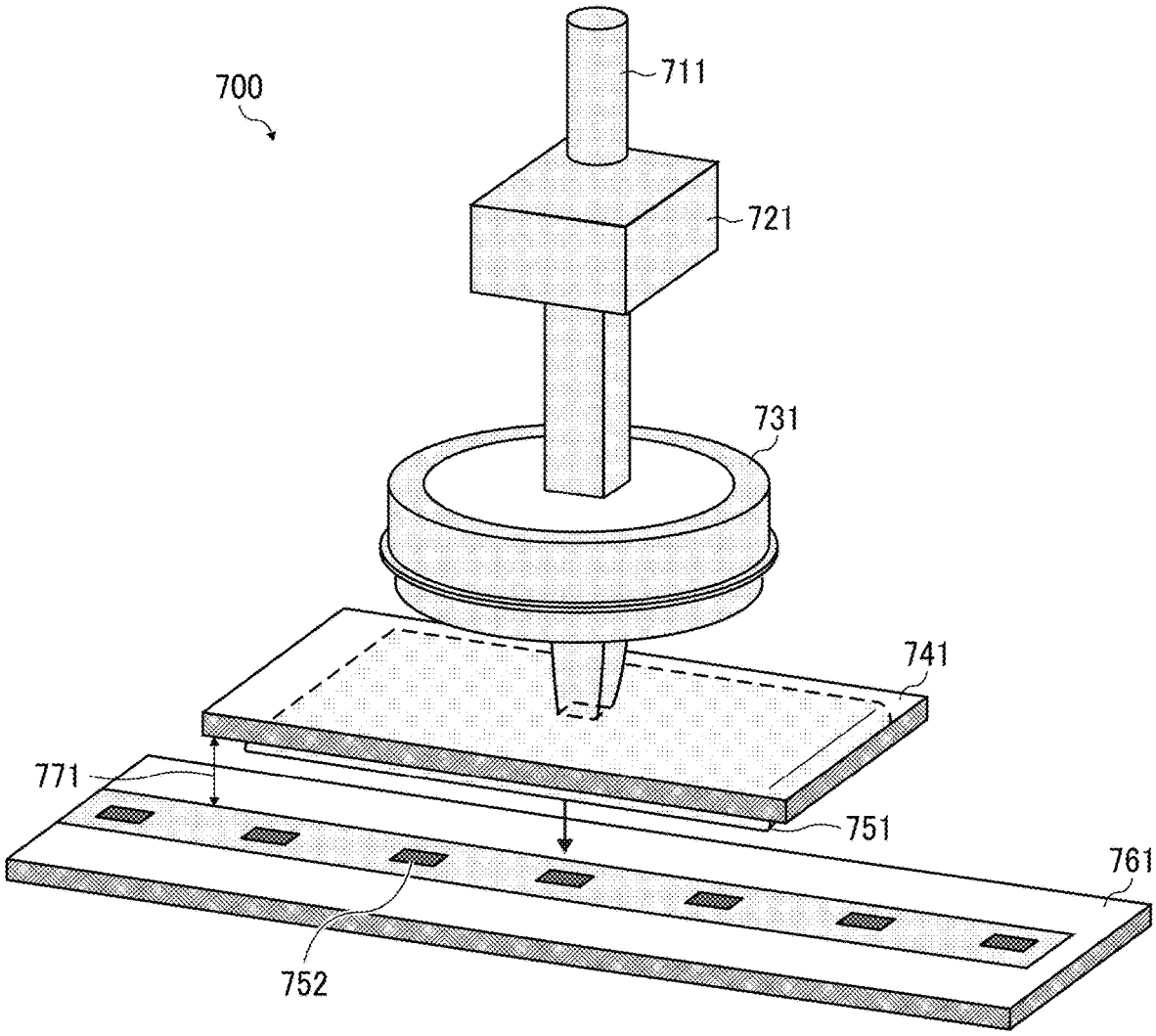
FIG. 15A is a schematic view illustrating one example of a flying object generating device configured to perform a method for preparing a measurement sample for mass spectrometry.

FIG. 15A is a schematic view illustrating one example of the flying object generating device configured to perform the method for preparing the measurement sample for mass spectrometry.

As illustrated in FIG. 15A, a flying object generating device 700 includes a laser beam 711 emitted from a light source, a beam converting optical system 721, and a condensing optical system 731. The flying object generating device 700 is used together with a base 741, a flying target material 751, and an adherent receiving medium 761. In the flying object generating device 700, the laser beam 711 emitted from the light source passes through the beam converting optical system 721 and the fθ as the condensing optical system 731 for conversion to a desired beam profile, and is applied to the flying target material 751 through the base 741. The flying target material 751 after irradiation with the laser beam 711 flies towards the adherent receiving medium 761 provided to face, with an interval (a gap) 771, the flying target material 751 disposed on the base 741, and adheres to the adherent receiving medium 761 (adhered flying target material 752). The interval (gap) 771 between the flying target material 751 and the adherent receiving medium 761 is adjusted with a gap retaining unit. The position of the adherent receiving medium 761 in the plane direction can be adjusted by a position adjusting unit.

Figure 15B:
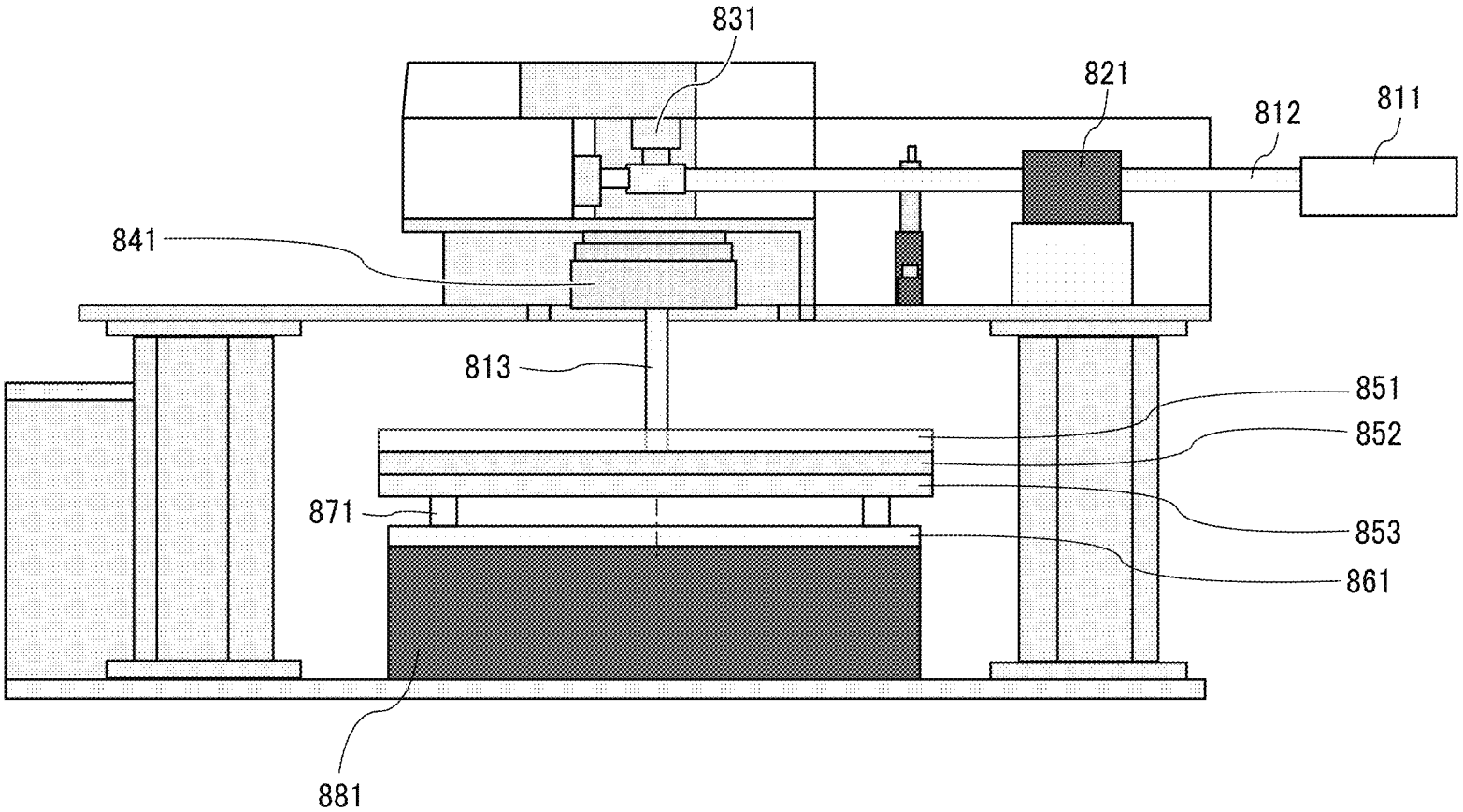
FIG. 15B is a schematic view illustrating another example of a flying object generating device configured to perform a method for preparing a measurement sample for mass spectrometry.

FIG. 15B is a schematic view illustrating another example of a flying object generating device.

As illustrated in FIG. 15B, the figure is drawn as an axially symmetrical model for the sake of convenience. As illustrated in FIG. 15B, the flying object generating device includes a light source 811, abeam converting optical system 821, an (X-Y) Galvano scanner 831 as a scanning optical system, and a condenser lens 841 as a condensing optical system. In the flying object generating device, a transparent object (base) 851 can be provided over a sample stage 881. The transparent object (base) 851 is provided with a flying object material 853 and a laser energy absorbable material (assist film) 852 on at least part of a surface thereof. The flying object generating device also includes a gap retaining member 871 configured to provide a gap between the transparent object (base) 851 and the adherent receiving medium (acceptor substrate) 861. The flying object generating device converts a Gaussian beam 812, which is emitted from a light source 811, to a uniformly heating irradiation laser beam 813 in the beam converting optical system 821.

In one example of the flying object generating device illustrated in FIG. 15B, a flying target material flying unit including the light source 811, the beam converting optical system 821, the Galvano scanner 831, and the condenser lens 841 applies a laser beam 813 towards the transparent object (base) 851 from the side of the front side opposite to the surface on which the flying target material 853 is disposed, to make the flying target material 853 fly in the direction in which the laser beam 813 is applied. In one example of the flying object generating device illustrated in FIG. 15B, moreover, the flying target material 853 (flying object) made fly adheres to the adherent receiving medium (target) 861.

The mass spectrometry of the present disclosure will next be described.

<Laser Beam Irradiation Step>

In the method for performing mass spectrometry by applying a laser beam to a matrix dot for mass spectrometry disposed on a surface of a measurement sample, the laser beam irradiation step in the mass spectrometry of the present disclosure is applying the laser beam in a manner that:

(A) a laser spot appearing in the measurement sample when the laser beam is applied to the matrix dot is completely enclosed in the matrix dot; or (B) the matrix dot is completely enclosed in a laser spot appearing in the measurement sample when the laser beam is applied to the matrix dot.

The laser beam is not particularly limited and may be appropriately selected depending on the intended purpose as long as in mass spectrometry, the laser beam can ionize the measurement sample and the matrix for mass spectrometry. It may be a laser beam used for MALDI mass spectrometry that is hitherto known.

The laser spot refers to a region of the ionized measurement sample and matrix for mass spectrometry, the region appearing by irradiating the measurement sample with the laser beam. The size of the laser spot varies with the shape of the laser beam irradiated. When the laser beam has a circular shape, the size thereof can be regarded the same as the diameter of the laser beam.

In the preparation of the measurement sample for mass spectrometry, the matrix for mass spectrometry is disposed on the surface of the measurement sample in the form of dots unless the laser beam is applied to the matrix base so that regions to be irradiated with the laser beam are continuous. Hereinafter, the matrix for mass spectrometry disposed on the surface of the measurement sample in the form of dots will be referred to as "matrix dots for mass spectrometry". In the following, the "matrix dots for mass spectrometry" may be referred to as "matrix dots".

Next, description will be given to applying the laser beam, in the laser beam irradiation step in the mass spectrometry of the present disclosure, in a manner that:

(A) a laser spot appearing when the measurement sample and the matrix dot are ionized is completely enclosed in the matrix dot; or (B) the matrix is completely enclosed in a laser spot appearing when the measurement sample and the matrix dot are ionized.

The case of applying the laser beam in a manner that (A) the laser spot is completely enclosed in the matrix dot will be described referring to some of the drawings.

First, a measurement sample for mass spectrometry is prepared by the method for preparing a measurement sample for mass spectrometry as described above. Second, a laser beam is applied for ionizing the measurement sample and the matrix dots.

Figure 12A:
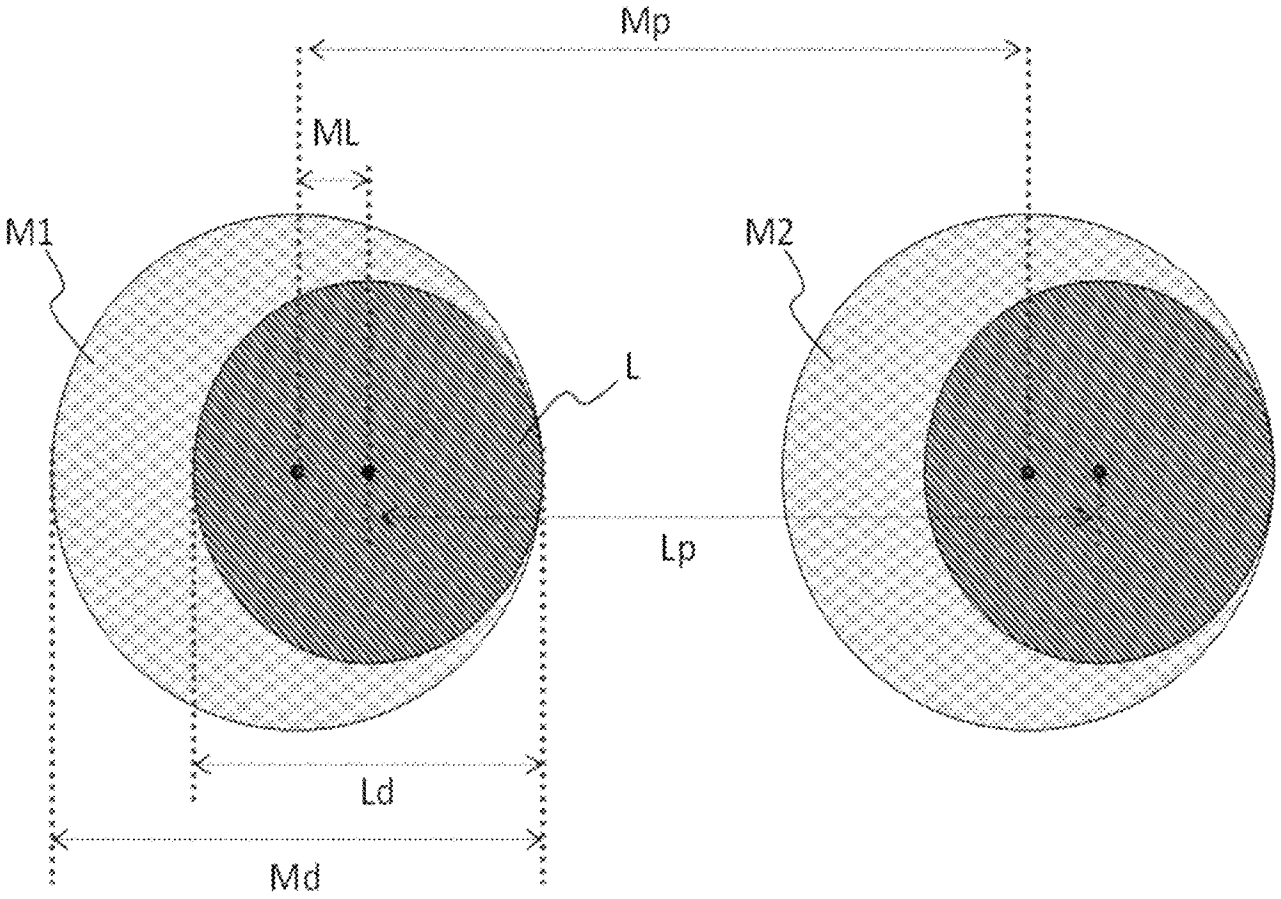
FIG. 12A is a schematic view illustrating one example of mass spectrometry of the present disclosure.

FIG. 12A is a conceptual view illustrating one example of the relationship between matrix dots M for mass spectrometry and laser spots L in the mass spectrometry of the present disclosure. As illustrated in FIG. 12A, when matrix dots M1 and M2 are irradiated with a laser beam, the laser spots L appearing in the measurement sample are completely enclosed in the regions of the matrix dots M1 and M2. In order to apply the laser beam in a manner that the laser spots are completely enclosed in the regions of the matrix dots M1 and M2 as illustrated in FIG. 12A, the laser beam is preferably applied so as to satisfy condition (A1): Md>Ld and condition (A2): ML<½ (Md−Ld), where Md denotes the diameter of the matrix dot for mass spectrometry, Ld denotes the diameter of the laser spot, and ML denotes the distance between the center Mc of the matrix dot for mass spectrometry and the center Lc of the laser spot. The ML refers to the distance between the center Mc of the matrix dot for mass spectrometry and the center Lc of the laser spot, when the distance between the center of the matrix dot for mass spectrometry and the center of the laser spot is minimum.

By applying the laser beam to the matrix dots so as to satisfy the condition (A1) and the condition (A2), regions of the surface of the measurement sample that have been irradiated with the laser beam can each be a region including the matrix dot. This makes it possible to make constant the amount of the measurement sample to be ionized in mass spectrometry. That is, it is possible to obtain highly precisely quantifiable results of mass spectrometry.

Next, the case of applying the laser beam in a manner that (B) the matrix dot is completely enclosed in the laser spot will be described referring to some of the drawings.

Figure 12B:
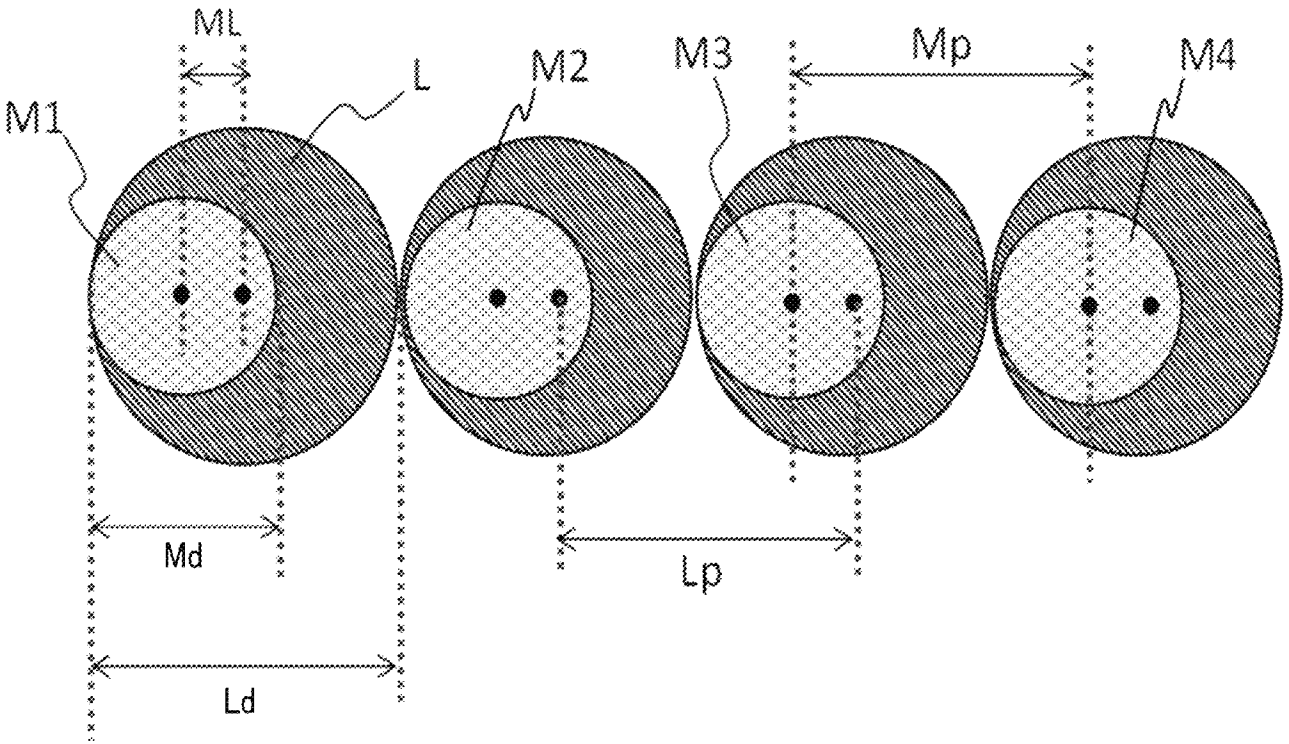
FIG. 12B is a schematic view illustrating another example of mass spectrometry of the present disclosure.

FIG. 12B is a conceptual view illustrating one example of the relationship between matrix dots M1, M2, M3, and M4 for mass spectrometry and laser spots L in the mass spectrometry of the present disclosure. As illustrated in FIG. 12B, the laser spots L appearing when the laser beam is applied to the matrix dots M1, M2, M3, and M4 for ionizing the measurement sample are formed so as to completely enclose the matrix dots. In order to apply the laser beam in a manner that the matrix dots M1, M2, M3, and M4 are completely enclosed in the laser spots L as illustrated in FIG. 12B, the laser beam is preferably applied so as to satisfy condition (B1): Md<Ld, condition (B2): ML<½ (Ld−Md), and condition (B3): Mp>Ld, where Md denotes the diameter of the matrix dot for mass spectrometry, Ld denotes the diameter of the laser spot, ML denotes the distance between the center Mc of the matrix dot for mass spectrometry and the center Lc of the laser spot, and Mp denotes the distance between the centers of the matrix dots for mass spectrometry that are adjacent to each other. The ML refers to the distance between the center Mc of the matrix dot for mass spectrometry and the center Lc of the laser spot, when the distance between the center of the matrix dot for mass spectrometry and the center of the laser spot is minimum.

By applying the laser beam to the matrix dots so as to satisfy the condition (B 1), the condition (B2), and the condition (B3), regions of the surface of the measurement sample that have been irradiated with the laser beam can each surely enclose the matrix dot. This makes it possible to make constant the amount of the measurement sample to be ionized in mass spectrometry of the matrix dots disposed on the surface of the measurement sample. That is, it is possible to obtain highly precisely quantifiable results of mass spectrometry.

In either case of the conditions described above, it is preferable that the matrix dots and the laser spots be regularly arranged and that the arrangement of the laser spots be in synchronization with the arrangement of the matrix dots.

As used herein, "regularly" refers to, for example, the distance Mp between the centers of the matrix dots being always constant, the distance Lp between the centers of the laser spots being always constant, the Mp being equal to the Lp, the line connecting the centers of the matrix dots with each other being a straight line, the line connecting the centers of the laser spots with each other being a straight line, or the line connecting the centers of the matrix dots overlapping the line connecting the centers of the laser spots.

"The arrangement of the laser spots being in synchronization with the arrangement of the matrix dots" refers to, for example, the distance Mp between the centers of the matrix dots being the same as the distance Lp between the centers of the laser spots.

The shape of the laser spot is not particularly limited and may be appropriately selected depending on the intended purpose. Examples of the shape include, but are not limited to, a circular shape, a polygonal shape, and an amorphous shape.

The shape of the laser spot can be adjusted depending on the shape of a laser beam caliber that emits the laser beam.

—Measurement Sample—

The measurement sample is not particularly limited and may be appropriately selected depending on the intended purpose as long as it can be subjected to mass spectrometry. Examples of the measurement sample include, but are not limited to, freeze-dried brain tissues, whole body sections of animals, seeds, and printed images.

—Matrix—

The matrix is the same as in the method for preparing a measurement sample for mass spectrometry.

It is preferable that the kind of a material of the matrix in the matrix dots disposed on the surface of the measurement sample be two or more and that the matrix dots of two or more different kinds of materials be disposed at mutually different positions on the surface of one measurement sample. When the kind of the matrix in the matrix dots disposed on the surface of the measurement sample is two or more, two or more kinds of matrices can be separately applied in one (sheet of) measurement sample and two or more kinds of mass spectrometry can be performed in one (sheet of) measurement sample.

The size of the matrix dot on the surface of the measurement sample is not particularly limited and may be appropriately selected depending on the intended purpose. In one measurement sample, all of the matrix dots may have the same size or the matrix dots may have different sizes.

The mass spectrometry of the present disclosure can be performed using a known apparatus as long as the laser beam can be applied so as to satisfy the conditions in the laser beam irradiation step as described above. Examples of the known apparatus include, but are not limited to, MALDI-TOF-MS (available from Bruker Daltonics Inc.).

<Other Steps>

The other steps are not particularly limited and may be appropriately selected depending on the intended purpose.

The mass spectrometry of the present disclosure can suitably be used in the mass spectrometry including applying a laser beam to a measurement sample to ionize the measurement sample. The mass spectrometry of the present disclosure can particularly suitably be used in the MALDI mass spectrometry.

EXAMPLES

The present disclosure will be described below by way of Examples. The present disclosure should not be construed as being limited to these Examples.

<Preparation of MALDI Mass Spectrometry Measurement Sample where Matrix Dots for Mass Spectrometry are Regularly Arranged>

—Preparation of Matrix for Mass Spectrometry—

——Preparation of Matrix Solution A——

Sinapic acid (SA) as Matrix A was dissolved in THE (obtained from Tokyo Chemical Industry Co., Ltd.) to prepare a sinapic acid THF solution having a solid portion concentration of 1% by mass, as Matrix Solution A.

——Preparation of Matrix Solution B——

2,5-Dihydroxybenzonic acid (DHB) as Matrix B was dissolved in THF (obtained from Tokyo Chemical Industry Co., Ltd.) to prepare a 2,5-dihydroxybenzonic acid THF solution having a solid portion concentration of 1% by mass, as Matrix Solution B.

—Preparation of Matrix Plate—

——Preparation of Matrix Plate A——

Figure 13:
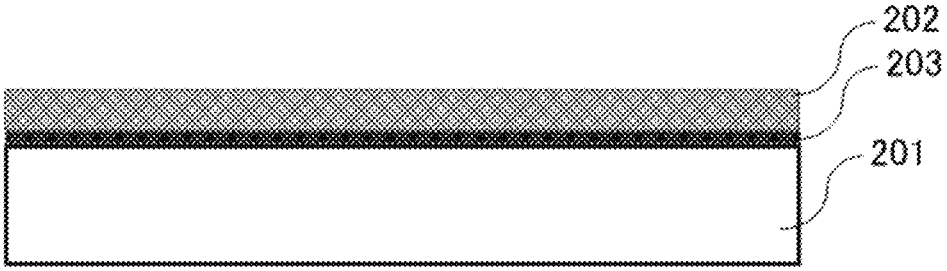
FIG. 13 is a view illustrating one example of a matrix plate in Examples.

Gold as a laser energy absorbable material 203 was vapor-deposited on one surface of a glass slide as the base 201 (S2441, Super frost white, obtained from Matsunami Glass Ind., Ltd.) so as to give an average thickness of 50 nm. Using the powder forming technique illustrated in FIG. 1D, the prepared Matrix Solution A was applied onto the gold-deposited surface to form powder of Matrix A having a primary average particle diameter of 20 μm in the longer sides of acicular crystals. Then, a powder layer 202 of Matrix A was formed so as to have an average thickness of 10 μm, to prepare Matrix Plate A having a structure illustrated in FIG. 13.

——Preparation of Matrix Plate B——

Matrix Plate B was prepared in the same manner as in Matrix Plate A except that Matrix Solution A was Matrix Solution B. Specifically, powder of Matrix B having a primary average particle diameter of 15 μm was formed, and then a powder layer of Matrix B was formed so as to have an average thickness of 10 μm, to prepare Matrix Plate B.

—Preparation of Measurement Sample Section—

Frozen mouse brain tissue (obtained from COSMO BIO CO., LTD.) as a measurement sample was placed in an Eppendorf tube. The measurement sample was crushed with added beads for crushing with a multi-beads shocker (MB2000, obtained from Yasui Kikai Corporation). The entire Eppendorf tube was cooled to −196° C. with liquid nitrogen, and the measurement sample was crushed again.

Figure 14:
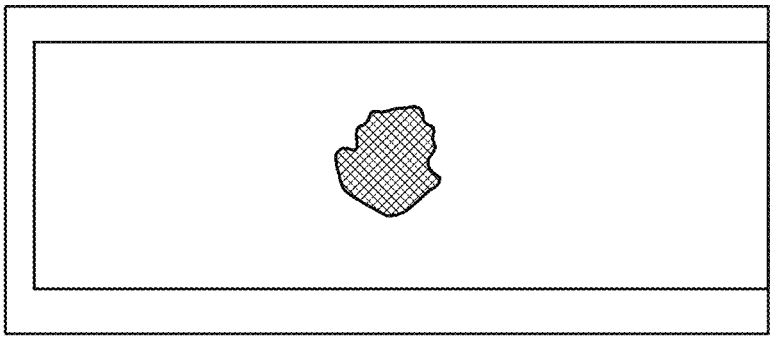
FIG. 14 is a photograph of one example of a measurement sample in Examples.

Next, the beads for crushing in the Eppendorf tube were removed with a dedicated magnet. The measurement sample was thawed at room temperature, followed by spinning down by means of a table-top centrifuge (MCF-2360, obtained from LMS Co., Ltd.). The Eppendorf tube was left to stand still for 3 hours in liquid nitrogen to re-freeze the measurement sample completely. The re-frozen measurement sample was cut with a cryomicrotome to produce a sample section having an average thickness of 10 μm. The measurement sample section was placed on an ITO-coated glass slide (free of MAS coating, 100Ω, obtained from Matsunami Glass Ind., Ltd.), as illustrated in FIG. 14.

—Preparation of Laser Beam Irradiation Unit—

——Laser Beam Irradiation Unit A——

As laser beam irradiation unit A, the laser beam irradiation unit 140 illustrated in FIG. 2 was used.

Specifically, as a laser beam source, a YAG laser configured to excite YAG crystals to oscillate laser was used. The laser beam source was used to generate a one-pulse laser beam having a wavelength of 1,064 nm, a beam size of 1.25 mm×1.23 mm, a pulse width of 2 nano seconds, and a pulse frequency of 20 Hz. The generated one-pulse laser beam was applied to a condenser lens (YAG laser condenser lens, obtained from SIGMAKOKI CO., LTD.) serving as a beam size changing member to adjust the size of the laser beam when applied to a matrix to 300 m×300 μm (diameter: 300 μm, laser spot shape: circle).

The laser beam having passed through the beam size changing member was applied to a LBO crystal (obtained from CESTEC) serving as the beam wavelength changing element to change the wavelength from 1,064 nm to 532 nm.

The laser beam was further passed through a vortex phase plate (Vortex phase plate, obtained from Luminex Corporation) to convert into an optical vortex laser beam.

The optical vortex laser beam converted by the vortex phase plate was passed through a quarter wave plate (QWP, obtained from Kogakugiken Corp.) disposed downstream of the vortex phase plate. The optical axis of the vortex phase plate and the optical axis of the quarter wave plate were set to +45° so that the total torque J represented by Formula (1) would be 2.

The converted optical vortex laser beam was passed through an energy adjusting filter (ND filter, obtained from SIGMAKOKI CO., LTD.) so that the laser output when applied to a matrix was adjusted to 50 μJ/dot.

The resultant laser beam was passed through an energy adjusting filter (ND filter, available from SIGMAKOKI CO., LTD.) so that the laser output when applied to a matrix was adjusted to 50 μJ/dot.

——Laser Beam Irradiation Unit B——

Laser beam irradiation unit B was provided in the same manner as in laser beam irradiation unit A except that the size of the laser beam when applied to a matrix to 80 μm×80 μm (diameter: 80 μm, laser spot shape: circle) and that the laser output when applied to a matrix was adjusted to 50 μJ/dot.

——Laser Beam Irradiation Unit C——

Laser beam irradiation unit C was a laser irradiation unit exemplified in FIG. 15A and FIG. 15B. A laser emitted by a Nd:YAG laser light source unit having a wavelength of 1,064 nm was passed through a spatial isolator, a λ/4 plate, and a collimating lens. An acoustooptic modulator (AOM)

temporally divided the laser to 0-order light and primary light based on an ON/OFF signal from a PC and a controller. In this way, the frequency of the laser light source was controlled. The 0-order light was cut when passing through mirrors and lenses, and only the primary light passed through a nonlinear optical crystal (SHG element). As a result, under nonlinear optical effects, a second harmonic (SHG) was generated, and green light having a wavelength of 532 nm was generated.

A harmonic separator HS obtained a laser beam (green light) having a single color of green by separating a fundamental harmonic and a second harmonic from each other.

The phase distribution and the intensity distribution of the obtained green light were corrected by aberration correction or by an aspect ratio magnification changing element, and then the green light passed through a zoom lens to be allowed to enter a laser beam transforming unit, as illustrated in FIG. 10A, configured to transform the light to a uniformly heating irradiation laser beam.

Subsequently, the beam passed through mirrors, ND, and other optical elements, and was reflected by an optical deflector such as a galvano mirror, so that the laser beam size when applied to a matrix was adjusted to 300 μm×300 μm through a condenser lens (focal length: 100 mm). The laser output was adjusted to 50 μJ/dot.

The beam was passed through an energy adjusting filter (obtained from SIGMAKOKI Co., LTD., a ND filter) to adjust the laser output when applied to a matrix, so that the laser output was adjusted to 50 μJ/dot.

——Laser Beam Irradiation Unit D——

Laser beam irradiation unit D was provided in the same manner as in laser beam irradiation unit C except that the laser beam size when applied to a matrix was adjusted to 80 μm×80 μm and that the laser output when applied to a matrix was adjusted to 50 μJ/dot.

[Preparation of Measurement Sample 1 for MALDI Mass Spectrometry]

First, the powder layer of Matrix A formed on the surface of Matrix Plate A was disposed to face the measurement sample section on the ITO-coated glass slide so that an optical vortex laser beam could be applied vertically to the back surface of Matrix Plate A with the laser beam irradiation unit A having the configuration illustrated in FIG. 2. The gap between the sample section and the powder layer of Matrix A was set to 200 μm.

Next, as illustrated in FIG. 11A, using laser beam irradiation unit A (laser beam size (diameter): 300 μm, laser spot shape: circle), an optical vortex laser beam was applied vertically to the back surface of Matrix Plate A, to make the powder of Matrix A fly from Matrix Plate A to dispose matrix dots at predetermined positions of the measurement sample section. As illustrated in FIG. 11B and FIG. 11C, the matrix dots (matrix dots A) were regularly arranged in two rows so that the diameter Md of the matrix dots would be 300 μm and the pitch Mp of the matrix dots would be 400 km.

Subsequently, Matrix Plate A was replaced with Matrix Plate B. Similar to Matrix Plate A, as illustrated in FIG. 11D, the powder of Matrix B was made fly from Matrix Plate B to arrange one row of the matrix dots at predetermined positions of the measurement sample section where Matrix A had not been disposed.

In this way, the measurement sample 1 for MALDI mass spectrometry was prepared which had two rows of Matrix A and one row of Matrix B.

Example 1

<Performance of MALDI Mass Spectrometry A>

The first row of the matrix dots A in the prepared measurement sample 1 for MALDI mass spectrometry was subjected to MALDI mass spectrometry using MALDI-TOF-MS (obtained from Bruker Daltonics Inc.) under the following conditions. The laser spot size of this apparatus (the diameter of the laser spot: Ld) was 100 μm.

First, calibration is performed with any standard sample to determine a laser power.

Next, the measurement sample 1 is set in a dedicated adapter. At this time, markings for positioning are provided at three or more sites with a permanent marker.

The scanning direction was set so that the centers of the rows of the matrix dots for mass spectrometry would be aligned in the laser scanning direction. The cumulative number of laser irradiations per spot was set to 200 times.

Results are given in Table 1.

<Conditions>

Diameter of the matrix dot for mass spectrometry, Md: 300 μm

Diameter of the laser spot, Ld: 100 μm

Distance between the center Mc of the matrix dot for mass spectrometry and the center Lc of the laser spot, ML: 90 μm Distance between the centers of the matrix dots for mass spectrometry, Mp (pitch): 400 μm Distance between the centers of the laser spots, Lp (pitch): 400 μm Example 2

In the same manner as in Example 1, MALDI mass spectrometry was performed on the row of the matrix dots B in the same measurement sample 1 as in Example 1. Results are given in Table 1.

Comparative Example 1

In the same manner as in Example 1 except that the conditions were changed as follows, MALDI mass spectrometry was performed on the second row of the matrix dots A in the same measurement sample 1 as in Example 1. Results are given in Table 1.

<Conditions>

Diameter of the matrix dot for mass spectrometry, Md: 300 μm

Diameter of the laser spot, Ld: 100 μm

Distance between the center Mc of the matrix dot for mass spectrometry and the center Lc of the laser spot, ML: 90 μm Distance between the centers of the matrix dots for mass spectrometry, Mp (pitch): 400 μm Distance between the centers of the laser spots, Lp (pitch): 150 μm

[Preparation of Measurement Sample 2 for MALDI Mass Spectrometry]

First, the powder layer of Matrix A formed on the surface of Matrix Plate A was disposed to face the measurement sample section on the ITO-coated glass slide so that an optical vortex laser beam could be applied vertically to the back surface of Matrix Plate A with the laser beam irradiation unit A having the configuration illustrated in FIG. 2. The gap between the sample section and the powder layer of Matrix A was set to 200 μm.

Next, as illustrated in FIG. 11A, using laser beam irradiation unit B (laser beam size (diameter): 800 μm, laser spot shape: circle), an optical vortex laser beam was applied vertically to the back surface of Matrix Plate A, to make the powder of Matrix A fly from Matrix Plate A to dispose the matrix dots at predetermined positions of the measurement sample section. As illustrated in FIG. 11B and FIG. 11C, the matrix dots were regularly arranged in two rows so that the diameter Md of the matrix dots would be 80 μm and the pitch Mp of the matrix dots would be 150 μm.

Subsequently, Matrix Plate A was replaced with Matrix Plate B. Similar to Matrix Plate A, as illustrated in FIG. 11D, the powder of Matrix B was made fly from Matrix Plate B to arrange one row of the matrix dots at predetermined positions of the measurement sample section where Matrix A had not been disposed.

In this way, the measurement sample 2 for MALDI mass spectrometry was prepared which had two rows of Matrix A and one row of Matrix B.

Example 3

<Performance of MALDI Mass Spectrometry B>

The first row of the matrix dots A in the prepared measurement sample 2 for MALDI mass spectrometry was subjected to MALDI mass spectrometry using MALDI-TOF-MS (obtained from Bruker Daltonics Inc.) under the following conditions. The laser spot size of this apparatus (the diameter of the laser spot: Ld) was 100 μm.

First, calibration is performed with any standard sample to determine a laser power.

Next, the measurement sample 1 is set in a dedicated adapter. At this time, markings for positioning are provided at three or more sites with a permanent marker.

The scanning direction was set so that the centers of the rows of the matrix dots for mass spectrometry would be aligned in the laser scanning direction. The cumulative number of laser irradiations per spot was set to 200 times.

Results are given in Table 1.

<Conditions>

Diameter of the matrix dot for mass spectrometry, Md: 80 μm

Diameter of the laser spot, Ld: 100 μm

Distance between the center Mc of the matrix dot for mass spectrometry and the center Lc of the laser spot, ML: 9 μm Distance between the centers of the matrix dots for mass spectrometry, Mp (pitch): 200 μm Distance between the centers of the laser spots, Lp (pitch): 400 μm

Example 4

In the same manner as in Example 1, MALDI mass spectrometry was performed on the row of the matrix dots B in the same measurement sample 2 as in Example 3. Results are given in Table 1.

Comparative Example 2

In the same manner as in Example 1 except that the conditions were changed as follows, MALDI mass spectrometry was performed on the second row of the matrix dots A in the same measurement sample 2 as in Example 3. Results are given in Table 1.

<Conditions>

Diameter of the matrix dot for mass spectrometry, Md: 80 μm

Diameter of the laser spot, Ld: 100 μm

Distance between the center Mc of the matrix dot for mass spectrometry and the center Lc of the laser spot, ML: 9 μm Distance between the centers of the matrix dots for mass spectrometry, Mp (pitch): 150 μm Distance between the centers of the laser spots, Lp (pitch): 200 μm

[Preparation of Measurement Sample 3 for MALDI Mass Spectrometry]

In the same manner as in Example 1 except that the laser beam irradiation unit A was changed to the laser beam irradiation unit C, measurement sample 3 for MALDI mass spectrometry was prepared.

Example 5

In the same manner as in Example 3 except that MALDI mass spectrometry was performed on the row of the matrix dots A in the measurement sample 3 for MALDI mass spectrometry. Results are given in Table 1.

[Preparation of Measurement Sample 4 for MALDI Mass Spectrometry]

In the same manner as in Example 3 except that the laser beam irradiation unit A was changed to the laser beam irradiation unit D, measurement sample 4 for MALDI mass spectrometry was prepared.

Example 6

In the same manner as in Example 3 except that MALDI mass spectrometry was performed on the row of the matrix dots A in the measurement sample 4 for MALDI mass spectrometry. Results are given in Table 1.

[Evaluation Method]

From the detected peak values for the positions of laser irradiations, Examples 1, 3, 5, and 6 and Comparative Examples 1 and 2 were compared in terms of changes from the detected peak value of 225 Da; i.e., the peak of sinapic acid.

From the detected peak values for the positions of laser irradiations, Examples 2 and 4 were compared in terms of changes from the detected peak value of 155 Da; i.e., the peak of 2,5-dihydroxybenzoic acid.

The change from the detected peak value was calculated from the following formula (1) or (2) and the larger value of the obtained values was used for the evaluation.

$$|(\text{Average value})-(\text{Minimum detected peak value})|/(\text{Average value}) \quad \text{Formula (1)}$$

$$|(\text{Average value})-(\text{Maximum detected peak value})|/(\text{Average value}) \quad \text{Formula (2)}$$

The change in each of the detected peak values being within 10% was evaluated as "accepted" and the change in each of the detected peak values being more than 10% was evaluated as "rejected".

TABLE 1

| | MALDI mass spectrometry | Kind of matrix | Diameter of the matrix dots for mass spectrometry Md (μm) | Pitch of the matrix dots for mass spectrometry Mp (μm) | Diameter of the laser spot Ld (μm) | Pitch of the laser spot Lp (μm) | Distance between the center of the matrix dot for mass spectrometry and the center of the laser spot ML (μm) |
|---|---|---|---|---|---|---|---|
| Ex. 1 | A | Sinapic acid | 300 | 400 | 100 | 400 | 90 |
| 2 | A | 2,5-Dihydroxybenzoic acid | 300 | 400 | 100 | 400 | 90 |
| Comp. Ex. 1 | Comparison relative to A | Sinapic acid | 300 | 400 | 100 | 150 | — |
| Ex. 3 | B | Sinapic acid | 80 | 200 | 100 | 200 | 9 |
| 4 | B | 2,5-Dihydroxybenzoic acid | 80 | 200 | 100 | 200 | 9 |
| Comp. Ex. 2 | Comparison relative to B | Sinapic acid | 80 | 150 | 100 | 200 | — |
| Ex. 5 | C | Sinapic acid | 80 | 200 | 100 | 200 | 9 |
| 6 | D | Sinapic acid | 80 | 200 | 100 | 200 | 9 |

TABLE 2

| | | Evaluation results | |
|---|---|---|---|
| | | Change in peak value | Judgment |
| Ex. | 1 | 3% or less | Accepted |
| | 2 | 5% or less | Accepted |
| Comp. Ex. 1 | | 50% or more | Rejected |
| Ex. | 3 | 8% or less | Accepted |
| | 4 | 8% or less | Accepted |
| Comp. Ex. 2 | | 50% or more | Rejected |
| Ex. | 5 | 5% or less | Accepted |
| | 6 | 8% or less | Accepted |

Out of the condition (A1): Md>Ld and the condition (A2): ML<½ (Md-Ld), Comparative Example 1 does not satisfy the condition (A2).

Out of the condition (B1): Md<Ld, the condition (B2): ML<½ (Ld-Md), and the condition (B3): Mp>Ld, Comparative Example 2 does not satisfy the condition (B2) and the conditions (B3).

The above results demonstrate that for mass spectrometry performed by applying the laser beam to the matrix dots for mass spectrometry disposed on the surface of the measurement sample, highly precisely quantifiable mass spectrometry can be performed when the laser beam is applied in a manner that (A) the laser spot is completely enclosed in the matrix dot for mass spectrometry or (B) the matrix dot for mass spectrometry is completely enclosed in the laser spot.

Aspects and embodiments of the present disclosure are, for example, as follows.

<1> Mass spectrometry comprising applying a laser beam to a matrix dot disposed on a surface of a measurement sample, wherein one of:

a laser spot appearing in the measurement sample when the laser beam is applied to the matrix dot; and the matrix dot, is completely enclosed in the other.

<2> The mass spectrometry according to <1> above, wherein condition (A) is satisfied in which the laser spot appearing in the measurement sample when the laser beam is applied to the matrix dot is completely enclosed in the matrix dot.

<3> The mass spectrometry according to <2> above, wherein condition (A1): Md>Ld and condition (A2): ML<½ (Md-Ld) are satisfied, where:

Md denotes a diameter of the matrix dot;

Ld denotes a diameter of the laser spot; and

ML denotes a distance between a center Mc of the matrix dot and a center Lc of the laser spot.

<4> The mass spectrometry according to <2> or <3> above, wherein the matrix dots and the laser spots of the laser beam applied are regularly arranged and an arrangement of the laser spots is in synchronization with an arrangement of the matrix dots.

<5> The mass spectrometry according to any one of <2> to <4> above, wherein the matrix dots disposed on the surface of the measurement sample are two or more kinds, and two or more kinds of the matrix dots are disposed at mutually different positions on the surface of the measurement sample.

<6> The mass spectrometry according to any one of <2> to <5> above, wherein the laser beam used for forming the matrix dot is an optical vortex laser beam.

<7> The mass spectrometry according to any one of <2> to <5> above, wherein the laser beam used for forming the matrix dot is a uniformly heating irradiation laser beam.

<8> The mass spectrometry according to any one of <2> to <7> above, wherein the mass spectrometry is MALDI mass spectrometry.

<9> The mass spectrometry according to <1> above, wherein condition (B) is satisfied in which the matrix dot is completely enclosed in the laser spot appearing in the measurement sample when the laser beam is applied to the matrix dot.

<10> The mass spectrometry according to <9> above, wherein condition (B1): Md<Ld, condition (B2): ML<½ (Ld−Md), and condition (B3): Mp>Ld are satisfied, where:

Md denotes a diameter of the matrix dot;

Ld denotes a diameter of the laser spot;

ML denotes a distance between a center Mc of the matrix dot and a center Lc of the laser spot; and Mp denotes a distance between the centers of the matrix dots that are adjacent to each other.

<11> The mass spectrometry according to <9> or <10> above, wherein the matrix dots and the laser spots of the laser beam applied are regularly arranged and an arrangement of the laser spots is in synchronization with an arrangement of the matrix dots.

<12> The mass spectrometry according to any one of <9> to <11> above, wherein the matrix dots disposed on the surface of the measurement sample are two or more kinds, and two or more kinds of the matrix dots are disposed at mutually different positions on the surface of the measurement sample.

<13> The mass spectrometry according to any one of <9> to <12> above, wherein the laser beam used for forming the matrix dot is an optical vortex laser beam.

<14> The mass spectrometry according to any one of <9> to <12> above, wherein the laser beam used for forming the matrix dot is a uniformly heating irradiation laser beam.

<15> The mass spectrometry according to any one of <9> to <14> above, wherein the mass spectrometry is MALDI mass spectrometry.

The mass spectrometry according to any one of <1> to <8> above can solve the existing problems and achieve the object of the present disclosure.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. Mass spectrometry comprising applying a laser beam to a matrix dot disposed on a surface of a measurement sample, wherein one of:

a laser spot appearing in the measurement sample when the laser beam is applied to the matrix dot; and the matrix dot, is completely enclosed in the other.

2. The mass spectrometry according to claim 1, wherein condition (A) is satisfied in which the laser spot appearing in the measurement sample when the laser beam is applied to the matrix dot is completely enclosed in the matrix dot.

3. The mass spectrometry according to claim 2, wherein condition (A1): Md>Ld and condition (A2): ML<½ (Md-Ld) are satisfied, where:

Md denotes a diameter of the matrix dot;

Ld denotes a diameter of the laser spot; and

ML denotes a distance between a center Mc of the matrix dot and a center Lc of the laser spot.

4. The mass spectrometry according to claim 2, wherein the matrix dots and the laser spots of the laser beam applied are regularly arranged and an arrangement of the laser spots is in synchronization with an arrangement of the matrix dots.

5. The mass spectrometry according to claim 2, wherein the matrix dots disposed on the surface of the measurement sample are two or more kinds, and two or more kinds of the matrix dots are disposed at mutually different positions on the surface of the measurement sample.

6. The mass spectrometry according to claim 2, wherein the laser beam used for forming the matrix dot is an optical vortex laser beam.

7. The mass spectrometry according to claim 2, wherein the laser beam used for forming the matrix dot is a uniformly heating irradiation laser beam.

8. The mass spectrometry according to claim 2, wherein the mass spectrometry is MALDI mass spectrometry.

9. The mass spectrometry according to claim 1, wherein condition (B) is satisfied in which the matrix dot is completely enclosed in the laser spot appearing in the measurement sample when the laser beam is applied to the matrix dot.

10. The mass spectrometry according to claim 9, wherein condition (B1): Md<Ld, condition (B2): ML<½ (Ld−Md), and condition (B3): Mp>Ld are satisfied, where:

Md denotes a diameter of the matrix dot;

Ld denotes a diameter of the laser spot;

ML denotes a distance between a center Mc of the matrix dot and a center Lc of the laser spot; and Mp denotes a distance between the centers of the matrix dots that are adjacent to each other.

11. The mass spectrometry according to claim 9, wherein the matrix dots and the laser spots of the laser beam applied are regularly arranged and an arrangement of the laser spots is in synchronization with an arrangement of the matrix dots.

12. The mass spectrometry according to claim 9, wherein the matrix dots disposed on the surface of the measurement sample are two or more kinds, and two or more kinds of the matrix dots are disposed at mutually different positions on the surface of the measurement sample.

13. The mass spectrometry according to claim 9, wherein the laser beam used for forming the matrix dot is an optical vortex laser beam.

14. The mass spectrometry according to claim 9, wherein the laser beam used for forming the matrix dot is a uniformly heating irradiation laser beam.

15. The mass spectrometry according to claim 9, wherein the mass spectrometry is MALDI mass spectrometry.

* * * * *